US007452054B2

(12) United States Patent
Ishikawa

(10) Patent No.: US 7,452,054 B2
(45) Date of Patent: Nov. 18, 2008

(54) IMAGE RECORDING DEVICE

(75) Inventor: Kan Ishikawa, Toyoake (JP)

(73) Assignee: Brother Kogyo Kabushiki Kaisha (JP)

( * ) Notice: Subject to any disclaimer, the term of this patent is extended or adjusted under 35 U.S.C. 154(b) by 502 days.

(21) Appl. No.: 11/115,370

(22) Filed: Apr. 27, 2005

(65) Prior Publication Data

US 2005/0243125 A1 Nov. 3, 2005

(30) Foreign Application Priority Data

Apr. 28, 2004 (JP) ..... 2004-134503

(51) Int. Cl.
*B41J 23/00* (2006.01)
*B41J 2/01* (2006.01)

(52) U.S. Cl. ..... 347/37; 347/101

(58) Field of Classification Search ..... 347/37, 347/101

See application file for complete search history.

(56) References Cited

U.S. PATENT DOCUMENTS 4,566,814 A 1/1986 Papp et al.
5,026,185 A 6/1991 Kusabuka
5,777,634 A * 7/1998 Okamura et al. ..... 347/7
6,789,966 B2 9/2004 Tanaka et al.
7,151,717 B2 * 12/2006 Sugiyama ..... 369/30.07
2002/0146266 A1 10/2002 Tanaka et al.
2003/0076379 A1 4/2003 Yusef et al.
2005/0001875 A1 * 1/2005 Ueda et al. ..... 347/37

FOREIGN PATENT DOCUMENTS

JP 63-233869 9/1988
JP 7061084 3/1995
JP 2002254746 9/2002

* cited by examiner

*Primary Examiner*—An H Do
(74) *Attorney, Agent, or Firm*—Banner & Witcoff, Ltd.

(57) ABSTRACT

An image recording device includes: a carriage; a recording head mounted on the carriage and discharges ink to form an image on the recording medium; first and second guide plates formed in flat-shape on which the carriage is slidably provided and extend in a main scanning direction to be parallel with each other; a drive motor mounted at one end of the second guide plate; a drive pulley fixed on a drive shaft of the drive motor; a driven pulley disposed on the second guide plate at other end opposite to the one end where the drive motor is mounted; and a timing belt that is wound around a pulley portion of the drive pulley and a pulley portion of the driven pulley, the timing belt being fixedly attached to an attachment portion of the carriage.

19 Claims, 22 Drawing Sheets

IMAGE RECORDING DEVICE

BACKGROUND OF THE INVENTION

1. Field of the Invention

The present invention relates to a configuration of an image recording device for recording an image on a recording medium by reciprocally actuating a carriage on which a recording head of an inkjet-type, or the like, is mounted.

2. Description of the Related Art

Conventionally, a variety of image recording devices of a type, in which a carriage with a recording head mounted thereon is supported so as to be able to perform reciprocal travel along a main scanning direction, have been devised. For instance, as disclosed in JP-A-7-061084, in a conventional image recording device, a round-shaft-like guide shaft, which is disposed horizontally on the device main body, penetrates through a bearing portion of the carriage, thereby being slidably supported.

In JP-A-7-061084, contrivance has been put to elimination of rattling resulting from a gap between a bearing portion of a carriage and a guide shaft, and has adopted the following configuration. To this end, a drive pulley, which is attached to a drive shaft of a drive motor, and a tension pulley on a follower side are disposed with an appropriate clearance therebetween in the main scanning direction. A carriage belt is wrapped around the drive pulley and the tension pulley, parallel to a round-shaft-shaped guide shaft; and a portion of the carriage belt is connected to the carriage. Here, a component force of a tension exerted from the carriage belt at this time is caused to act on the carriage in a direction orthogonal to the main scanning direction.

However, since the guide shaft passes through the bearing portion of the carriage, when the carriage is removed from the guide shaft for maintenance or replacement, the guide shaft must first be removed from the frame, and subsequently the carriage must be further removed from the guide shaft; and for assembly of the same, the reverse procedure must be performed, thereby posing considerable difficulty in attachment of the carriage. In addition, the drive pulley and the tension pulley must be attached to another frame different from that of the guide shaft. Accordingly, the structure is complicated, and an attempt to miniaturize the device has encountered difficulty.

A document JP-A-2002-254746 discloses an image recording device which, in order to curtail cost, does not use an expensive round guide shaft, and supports a carriage through use of two carriage guide plates assuming the shape of a metal plate. Specifically, a first carriage guide plate having a Z-shaped cross-sectional profile is formed at an arbitrary vertical point on a main frame standing upright, by means of cutting, and pulling up the cut portion. A first guide section downwardly projecting from one lower surface of the carriage is brought into contact with and slidably supported on the upper surface of the horizontal first position regulation plate. A third guide section projecting laterally from a lower portion of the carriage so as to face the lower surface (slide surface) of a first guide section is caused to face the lower surface of the first position regulation plate.

A portion projecting into a downwardly-facing U-lettered shape from a rear area of the carriage is provided with a pair of second guide sections such that both surfaces of a second position regulation plate bent upwardly from the tip end of the first position regulation plate are sandwiched between the pair of second guide sections.

A lower surface (slide surface) of a fourth guide section projecting downward from the other lower surface of the carriage is brought into contact (slidable contact) with a third position regulation surface (upper surface) of the second horizontal carriage guide plate. A portion of an unillustrated endless belt is coupled to a belt-receiving section provided at the rear end of the carriage, thereby enabling the carriage to reciprocally travel in the main scanning direction.

SUMMARY OF THE INVENTION

However, from the configuration of JP-A-2002-254746, only the belt-receiving section can be understood to be formed long in a horizontal direction (see FIG. 3 of JP-A-2002-254746), and the layout of the endless belt is uncertain. Even if a drive pulley and a driven pulley are attached to a vertical surface of a longitudinally-elongated main frame, the height of the main frame is large, which in turn poses difficulty in miniaturizing the image reading apparatus.

With a view toward solving the drawback of the conventional technique, the present invention provides an image recording device in which fixing action of a drive pulley and that of a driven pulley contribute to actuation of a horizontal guide plate in a main scanning direction of a carriage and which makes quality of a recorded image stray and the image recording device compact by means of putting contrivance to the layout of the drive pulley and the driven pulley.

According to one aspect of the invention, there is provided an image recording device including: a carriage that moves reciprocally in a main scanning direction that is perpendicular to a sub scanning direction in which a recording medium is transported; a recording head mounted on the carriage and discharges ink to form an image on the recording medium; first and second guide plates formed in flat-shape on which the carriage is slidably provided and extend in the main scanning direction to be parallel with each other; a drive motor mounted at one end of the second guide plate; a drive pulley fixed on a drive shaft of the drive motor; a driven pulley disposed on the second guide plate at other end opposite to the one end where the drive motor is mounted; and a timing belt that is wound around a pulley portion of the drive pulley and a pulley portion of the driven pulley, the timing belt being fixedly attached to an attachment portion of the carriage.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Next, an embodiment of the invention will be explained below.

Figure 1:
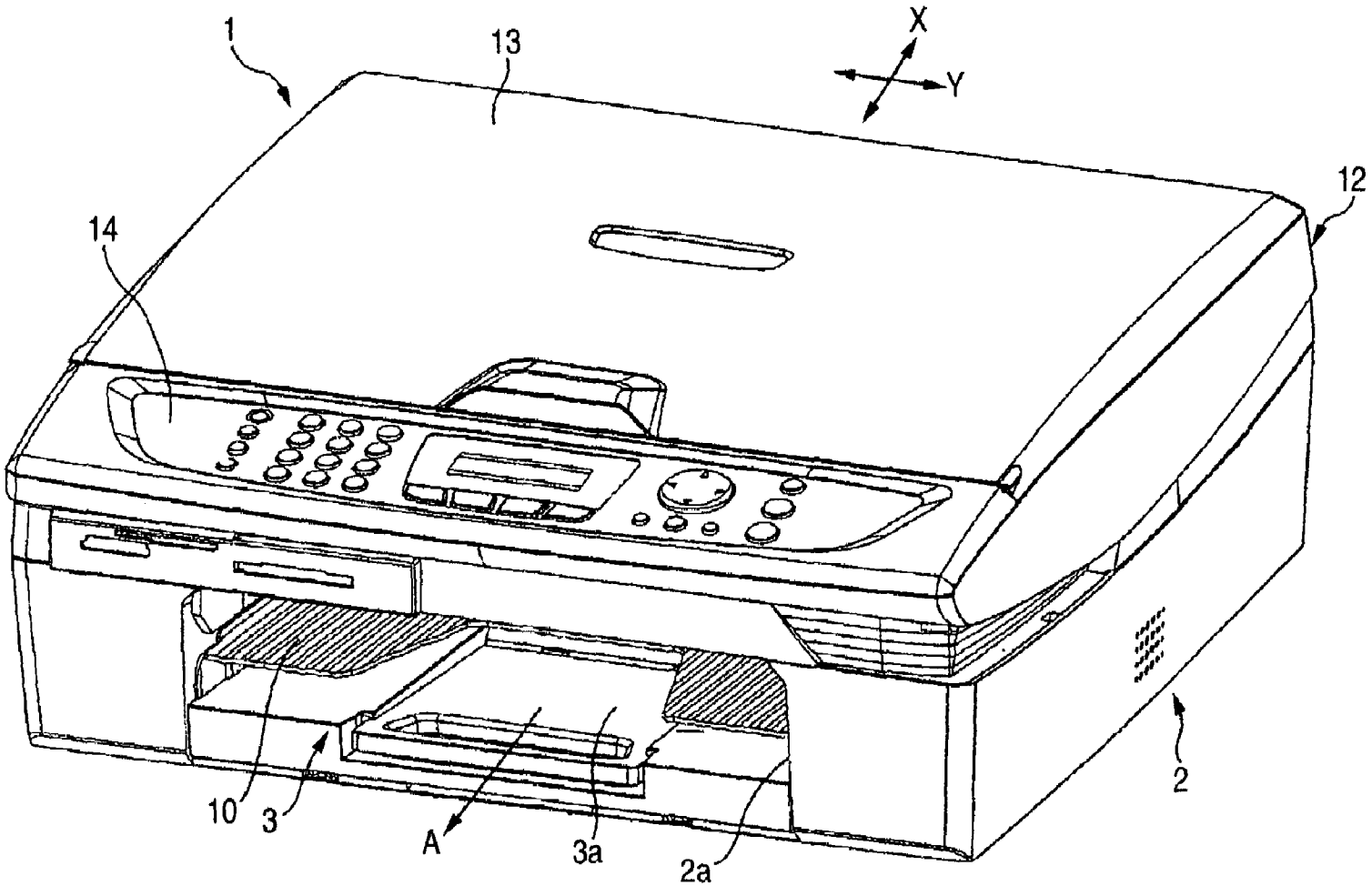
FIG. 1 is a perspective view of an image recording device of an embodiment of the present invention.
Figure 2:
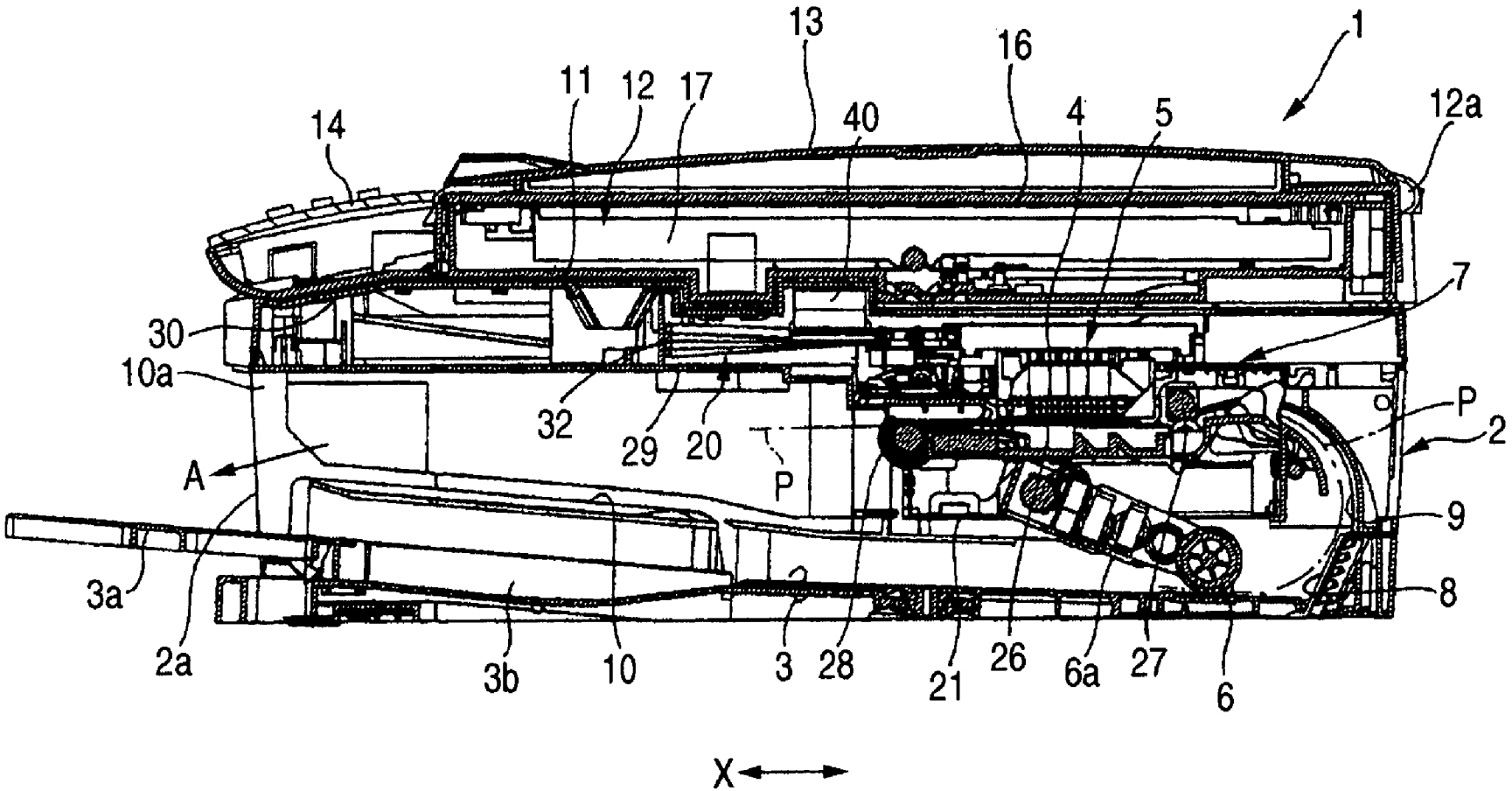
FIG. 2 is a side cross-sectional view of the image recording device of an embodiment of the present invention.

An image recording device 1 of the embodiment is a multi-function device (MFD), to which the present invention is applied, having a printer function, a copying function, a scanner function, and a facsimile function. As shown in FIGS. 1 and 2, a paper feed cassette 3 is disposed at the bottom of a housing 2, which serves as a recording device main body, made from a synthetic resin, of the image recording device 1 and which is constituted of a synthetic resin injection molded article. The paper feed cassette 3 is an example of a tray that can be inserted through an opening 2*a* disposed in the front (on the left side in FIG. 2) of the bottom section of the housing 2.

In the embodiment, the paper feed cassette 3 is assumed to have a configuration such that paper P—which is cut into, for instance, A4-size, letter size, legal size, or postcard size, and which serves as a recording medium—can be stored in such a manner that a plurality of sheets of the paper P are stacked (accumulated) with the shorter sides thereof extending in a direction (a direction perpendicular the sheet plane in FIG. 2; a main scanning direction or Y axis direction) perpendicular to a paper-transport direction (a sub scanning direction or X axis direction). Meanwhile, to a front end of the paper feed cassette 3, an auxiliary support member 3*a* which supports a rear end section of elongated paper P of, for example, legal size, is attached movably along the direction of the X axis. FIG. 2 shows a state where the auxiliary support member 3*a* is disposed at a position protruding out of the housing 2. However, when paper P of A-4 size, or the like, which can be housed in the paper cassette 3 (i.e., the paper P does not project out of the housing 2 through the opening 2*a*) is used, the auxiliary support member 3*a* can be stored in a storage section 3*b* so as not to interfere with paper feeding.

A sloped section 8 for separating paper is disposed at a rear side (on the right side in FIG. 2) of the paper feed cassette 3. An arm 6*a*, whose upper end portion in a paper feed mechanism 6 can be vertically pivoted, is attached to the housing 2 side. A paper feed roller 6*b*, disposed at a lower end of the paper feed arm 6*a*, and the sloped section 8 separate and convey, one sheet at a time, paper P which serves as a recording medium and which is stacked (accumulated) on the paper feed cassette 3. The thus-separated paper P is fed to a recording section 7 by way of a U-turn path (feed passage) 9 which is oriented laterally and moves the paper upward. The recording section 7 is disposed at a position above (at a higher position) and to the rear of the paper feed cassette 3. As will be described later, the recording section 7 is constituted of a carriage 5 capable of reciprocating, and the like. An inkjet-type recording head 4 for implementing a printing function, and the like, is mounted on the carriage 5.

A paper discharge section 10 is formed above the paper feed cassette 3, and paper P having been subjected to recording in the recording section 7 is discharged onto the paper discharge section 10 with the recorded surface facing upward. A paper discharge port 10*a* in communication with the paper discharge section 10 is opened in a common opening with the opening 2*a* on the front face of the housing 2.

An image-reading device 12 for performing document reading, and the like, for a copying function and a facsimile function is disposed above the housing 2. There is employed such a configuration that a bottom wall 11 of the image-reading device 12 is superimposed on an upper cover body 30, which will be described later, from above the same with substantially no clearance therebetween. The image-reading device 12 is configured such that the image-reading device 12 is vertically reclosable and pivotray on one side end of the housing 2 by way of an unillustrated pivot shaft portion. Furthermore, a rear end of a document cover body 13 for covering an upper face of the image-reading device 12 is attached to a rear end of the image-reading device 12 in such a manner that the document cover body 13 can vertically pivot about a pivot shaft 12*a*.

On the upper side of the housing 2, an operation panel section 14 provided with a variety of operation buttons, an LCD section, and the like, is disposed forward of the image-reading device 12. The operation panel section 14 is arranged so that the recording section 7, the paper discharge section 10, and an ink storage section 15, disposed on one side of the paper discharge section 10, are located within a projection area of the image-reading device 12 and the operation panel section 14 in plan view. In addition, in a state where the auxiliary support member 3*a* is contained in the storage section 3*b*, length in the direction of the X axis of the paper feed cassette 3 is substantially equal to those of the image recording device 12 and the operation panel section 14. Accordingly, the image recording device 1 assumes the shape of a substantially rectangular solid which is substantially square shape in plan view. Therefore, packing for shipment as a product is facilitated, and a packaging box can also be miniaturized.

Figure 3:
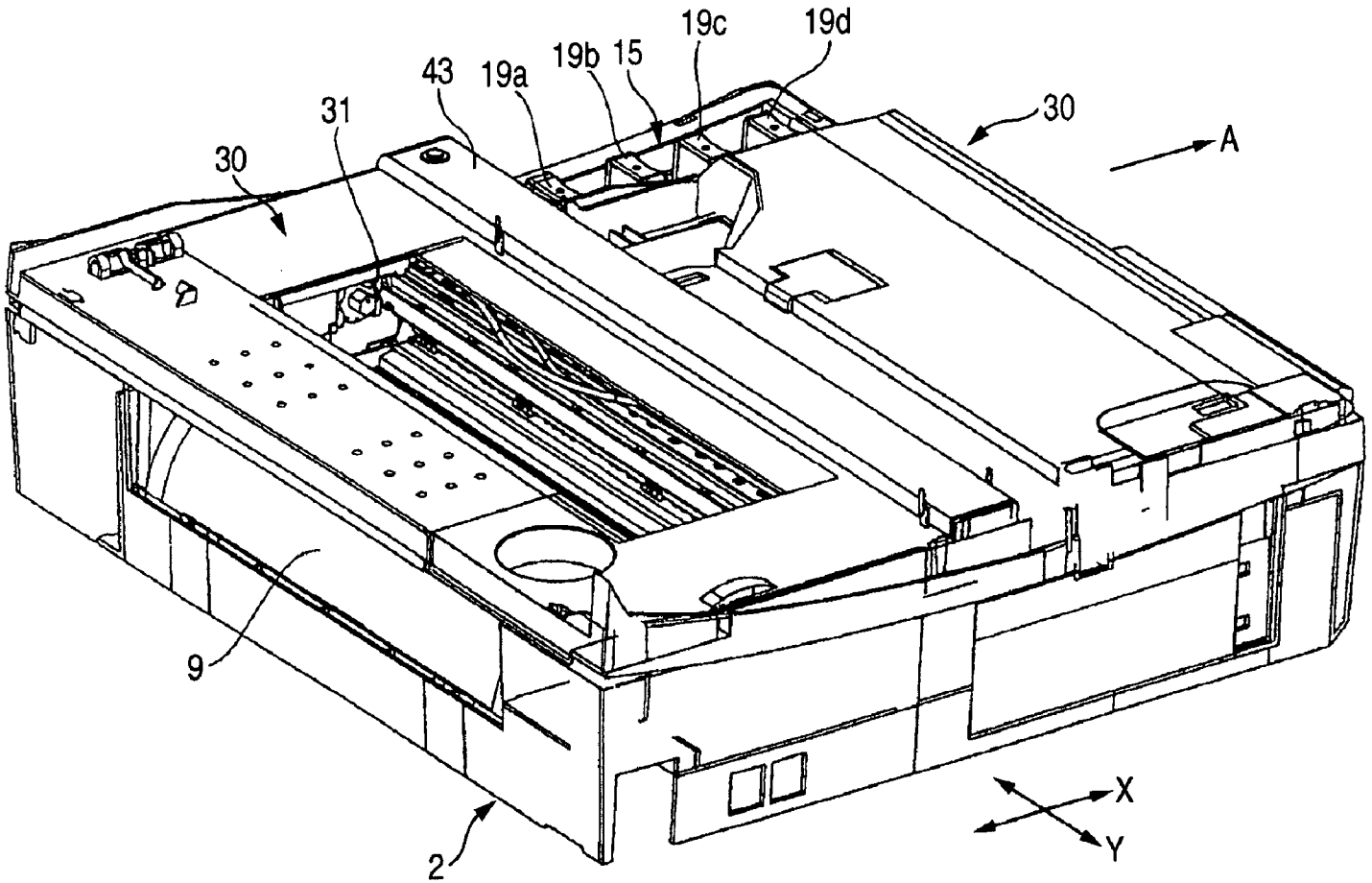
FIG. 3 is a perspective view of a housing.

On the upper surface of the image-reading device 12, there is disposed a document glass plate 16 on which a document can be placed after the document cover body 13 is opened upward. An image scanner device (CIS: contact image sensor) 17 for reading the document is disposed below the document glass cover 16 so as to allow reciprocation in a direction (the main scanning direction, and the direction of the Y axis in FIGS. 1, 3, and 4) orthogonal to the sheet plane in FIG. 2.

The ink storage section 15 is open upward of the housing 2, and can store ink cartridges 19 in a column alignment along the direction of the X axis. The ink cartridges 19 containing four color inks for full-color recording is small in area in its plan view and of a substantially rectangular box shape which is large in height (cartridges of respective colors; that is, of black (BK), cyan (C), magenta (M), and yellow (Y), are denoted by reference numerals 19*a* to 19*d*; see FIGS. 3 and 4).

Figure 5:
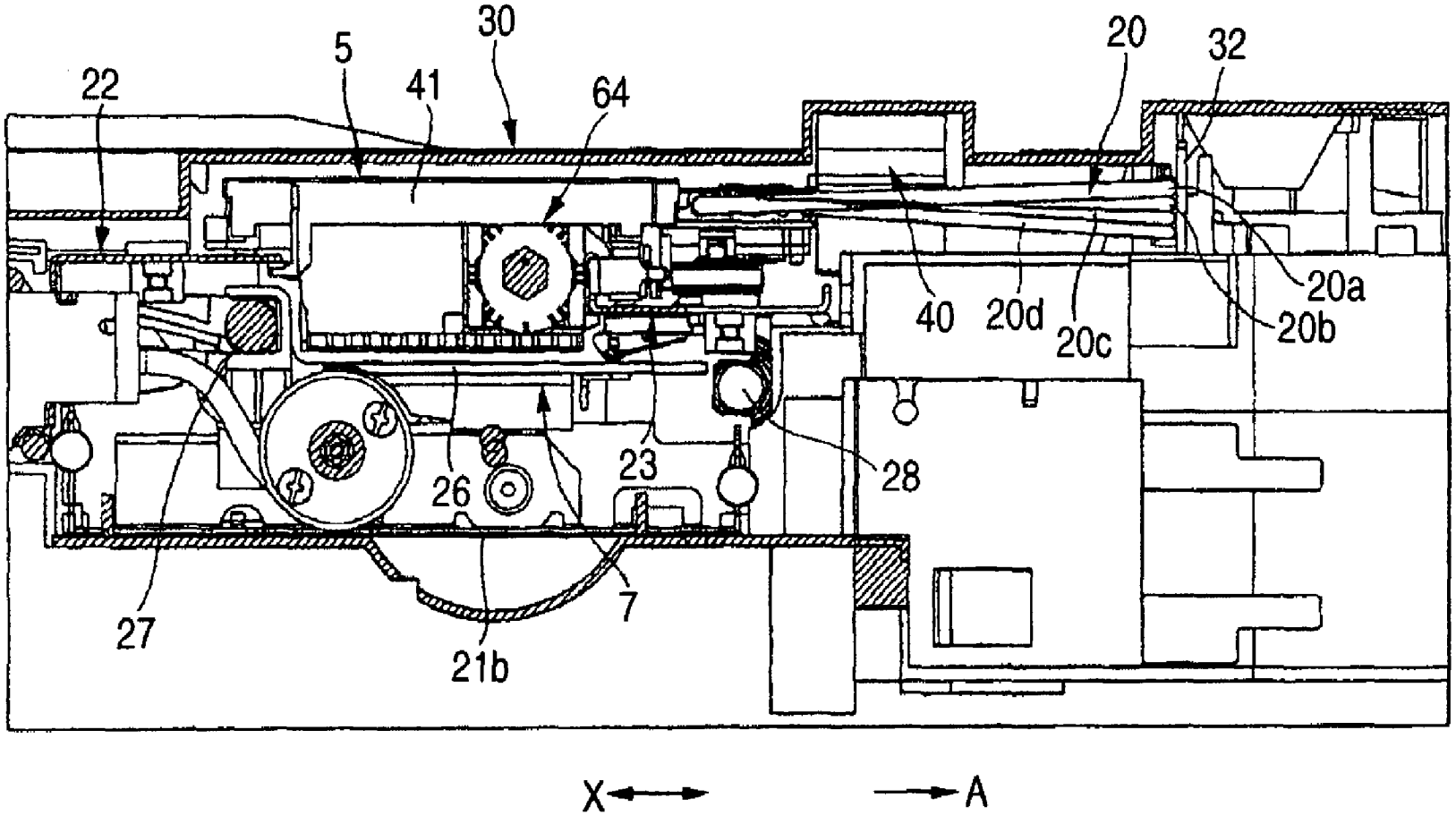
FIG. 5 is an enlarged side cross-sectional view taken along line V-V in FIG. 4.

Such a configuration is employed that ink is supplied from the respective ink cartridges 19 to the inkjet-type recording head 4 by way of a plurality of (in the embodiment, four) ink supply tubes (ink tubes) 20 (independently, denoted by reference numerals 20*a* to 20*d*; see FIG. 5). Meanwhile, when a greater number of ink colors (six to eight colors) than four colors are employed, the ink storage section 15 may be configured so as to be able to contain ink cartridges of the number corresponding to the number of ink colors; and the ink supply tubes may also be increased in number in accordance with the number of ink cartridges.

As shown in FIGS. 4 through 7, the recording section 7 includes laterally-elongated, plate-like guide plates (guide members) 22, 23 which are supported by a pair of right and left side plates 21*a* in the main frame 2, extend in the direction of the Y axis (the main scanning direction), and are made of metal (a steel plate); a carriage 5 which is slidably supported (mounted) so as to straddle the guide plates 22, 23 and is reciprocally movable; a timing belt 24 disposed on an upper surface of the guide plate 23 located downstream of the paper transport direction (the direction of arrow A) for reciprocally actuating the carriage 5 with the recording head 4 mounted thereon; a drive motor [a CR (carriage) motor] 25 (although embodied by a DC motor in the embodiment, the drive motor may also be embodied by another motor such as a stepping motor) for actuating the timing belt 24 extending in the main scanning direction; a plate-like platen 26 for supporting the paper P transported along a position close to the lower surface of the recording head 4; and an encoder strip 47 or the like which is arranged so as to extend in the main scanning direction and detects the position of the carriage 5 in the direction of the Y axis (the main scanning direction). The encoder strip 47 is arranged such that an inspection surface thereof (a surface in which slits are formed at given intervals with respect to the direction of the Y axis) is aligned in the vertical direction.

A pair of registration rollers 27 are disposed upstream with respect to the paper transport direction with the platen 26 sandwiched therebetween, and the paper P is fed toward the lower surface of the recording head 4. Spur wheels (not shown) which come into contact with the upper surface of the paper P and the paper discharge roller 28 located on the lower surface side of the paper P are disposed, and the recorded paper P is transported to the paper discharge section 10.

An ink receiving section 38 is provided at a position on one end (a location which is close to a left side plate 21*a* in FIG. 7 in the present embodiment) outside the width (a shorter side of the paper P) of the transported paper P. Further, a maintenance unit 50 serving as maintenance mechanism to be described later is provided on the other side (a location close to a right side plate 21*a* in FIG. 7). According to the configuration, the recording head 4 periodically ejects ink for preventing clogging of nozzles in a flushing position set in the ink receiving section 38 during the course of recording operation, and the ejected ink is received by the ink receiving section 38. A standby position for the carriage 5 is set in the maintenance unit 50, and a cap section 50*a* of the maintenance unit 50 covers a nozzle surface of the recording head 4 from below to thus selectively suck ink on a per-color basis and to perform recovery processing, or the like, for removing air bubbles in an unillustrated buffer tank provided on the recording head 4. When the carriage 5 laterally approaches the maintenance unit 50, cleaning operation is performed for wiping the nozzle surface with an unillustrated cleaner (a wiper blade).

As shown in FIGS. 7 to 11, the recording section 7 is supported by the box-shaped main frame 21 and the pair of right and left side plates 21*a* and formed between the plate-like first and second guide members 22, 23 which extend in the direction of the Y axis (the main scanning direction).

Figure 7:
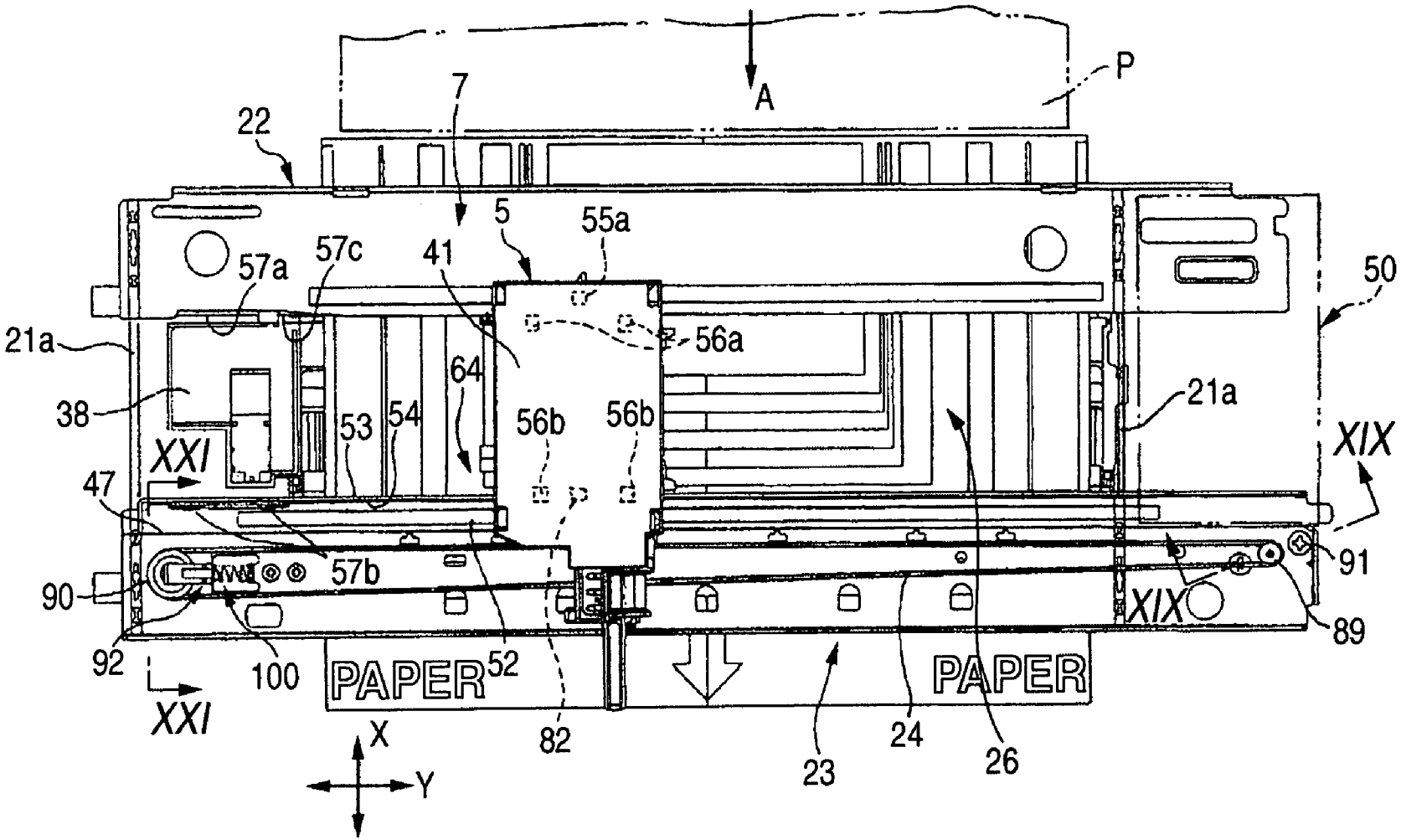
FIG. 7 is a plan view of a carriage and a pair of guide plates (a first guide plate and a second guide plate)
Figure 8:
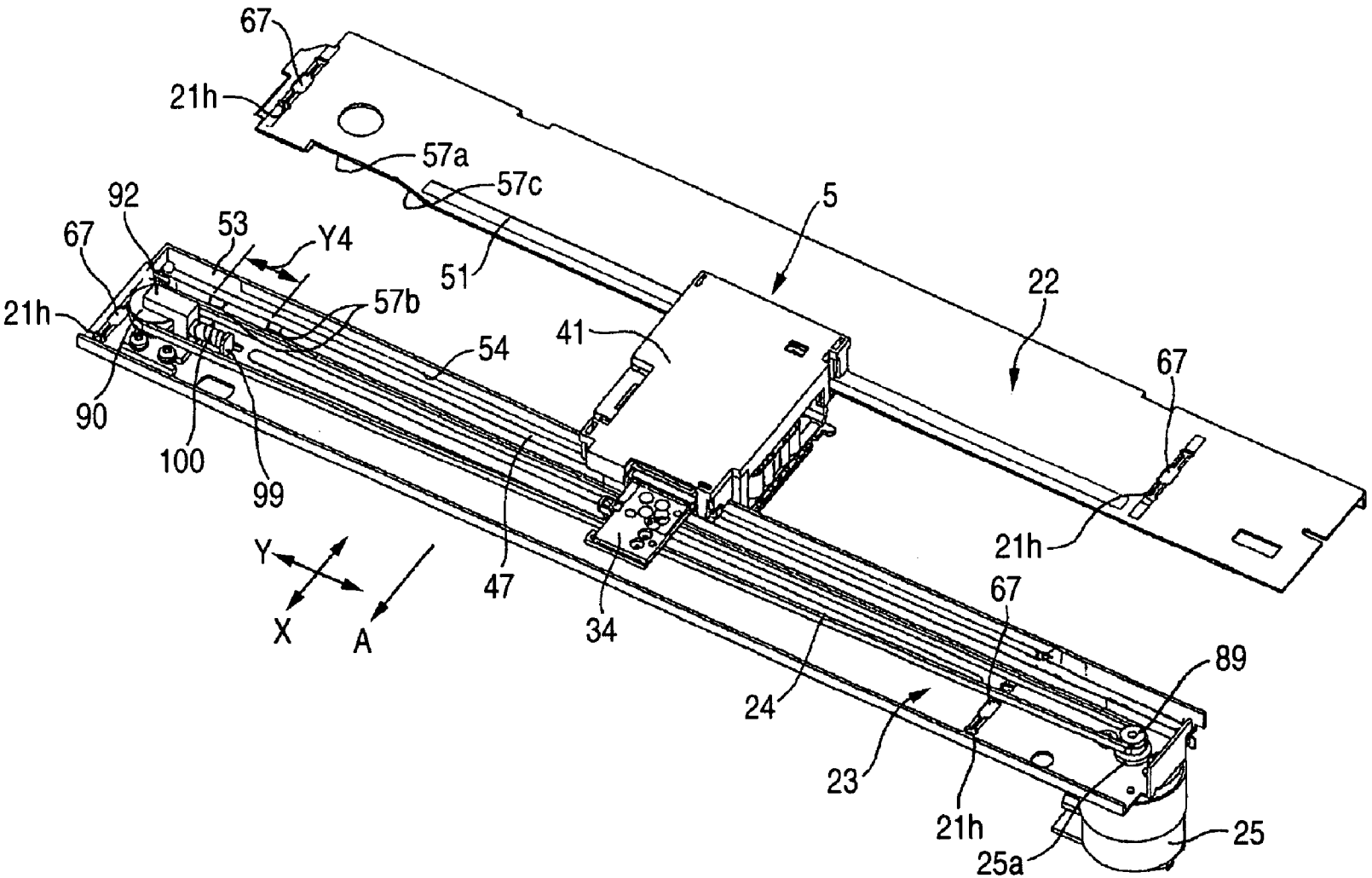
FIG. 8 is a perspective view of a carriage and a pair of guide plates.
Figure 9:
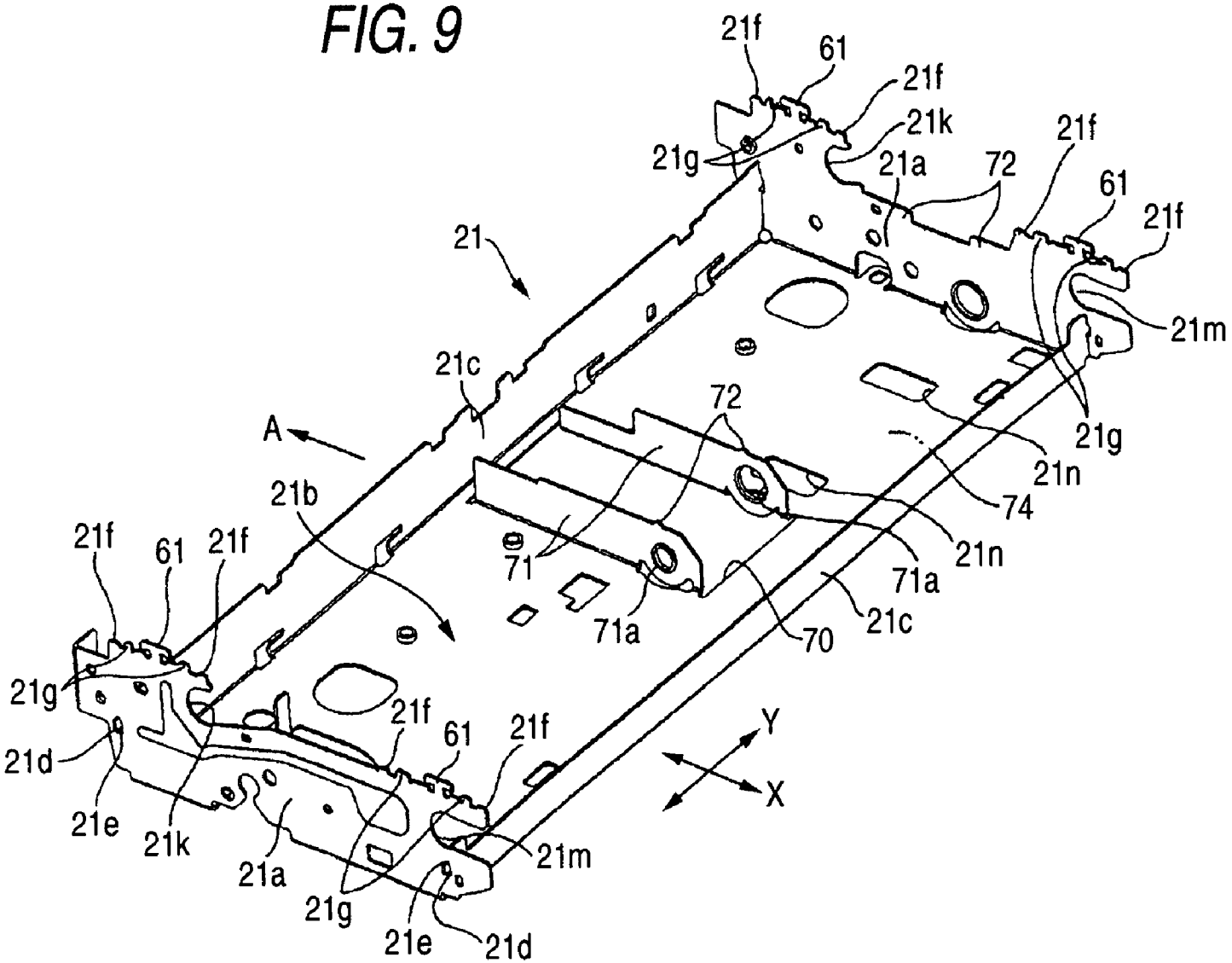
FIG. 9 is a perspective view of a main frame.

With reference to FIGS. 7 to 11, there will now be described the structure of the main frame 21 and the structure for mounting the upstream guide plate 22, which serves as the other guide plate, and the downstream guide member 23, which serves as the one guide plate, in a paper transport direction. As shown in FIG. 9, the main frame 21 is formed by: punching a sheet of metal plate (steel plate) into a predetermined shape; and bending the pair of side plates 21*a* and a pair of reinforcing plates 21*c* with reference to a bottom plate 21*b* so as to assume the shape of an upwardly-open box. Accordingly, the assembly operation becomes considerably simple. The pair of side plates 21*a* are formed by upwardly bending both ends of the bottom plate 21 in the longitudinal direction thereof (i.e., both ends of the bottom plate 21 in the direction of the Y axis) so as to stand upright. The pair of reinforcing plates 21*c* are formed by upwardly bending both ends of the bottom plate 21*b* in the lateral direction thereof (i.e., both ends of the bottom plate 21 in the direction of the X axis) so as to stand upright. Projections 21*d* (the projections 21*d* provided only on one side of the respective reinforcing plates 21*c* are shown in FIG. 9) provided on the respective ends of the pair of reinforcing plates 21*c* are fitted into holes 21*e* formed in the respective side plates 21*a* (see FIG. 10). A plurality of positioning protrusion sections 21*f* and T-shaped latching claws 61 are upwardly formed integrally on upper end faces of the respective side plates 21*a* for horizontally supporting lower surfaces of the horizontal plates of the first and second guide plates 22, 23 and defining the height positions of the horizontal plates (by extension, the height positions and levelness of first slide surfaces 51, 52, which will be described later) (see FIG. 9 and like drawings). Slit-shaped latching holes 67 into which the latching claws 61 can be inserted are formed in the horizontal plates of the first and second guide member plates 22, 23 (see FIG. 8). After the respective latching claws 61 have been fitted into the corresponding latching holes 67, the upper ends of the respective latching claws 61 are twisted left or right, whereby the latching claws 61 are fixedly crimped in a unremovable manner while the lower surfaces of the latching claws 61 remain in contact with the upper surfaces of the respective horizontal plates (see FIG. 10). As mentioned above, the latching claws 61 are twisted or bent while being fitted into the respective latching holes 67, to thus fix the respective guide plates 22, 23 to the main frame 21. As a result, the assembly operation becomes considerably simple, and the number of parts is maintained small.

At this time, a pair of projection sections 21*g* projecting from the upper end face of each side plate 21*a* with the latching claw 61 sandwiched therebetween (see FIG. 9) are fitted into positioning holes 21*h* adjacent to the latching holes 67 (see FIG. 8), thereby defining parallelism and an interval, which is orthogonal to the parallel direction, between the first and second guide members 22, 23. According to such configuration, the structure into which the main frame 21 and the two guide members 22, 23 are assembled assumes a box shape and has robust stiffness.

The carriage 5—on which is mounted the recording head 4—is slidably supported (mounted) so as to straddle the upstream guide plate 22 and the downstream guide plate 23 with respect to the paper transport direction, and becomes able to reciprocate. A first slide surface 51, which serves as a horizontal guide section, parallel to the lower surface of the recording head 4 of the carriage 5 (i.e., the head surface where the nozzle is formed) is formed in an area on the upper surface of the guide member 22 close to the carriage 5. A first slide surface 52, which also serves as a horizontal guide section, parallel to the lower surface of the same is formed in an area on the upper surface of the guide member 23 close to the carriage 5.

Figure 6:
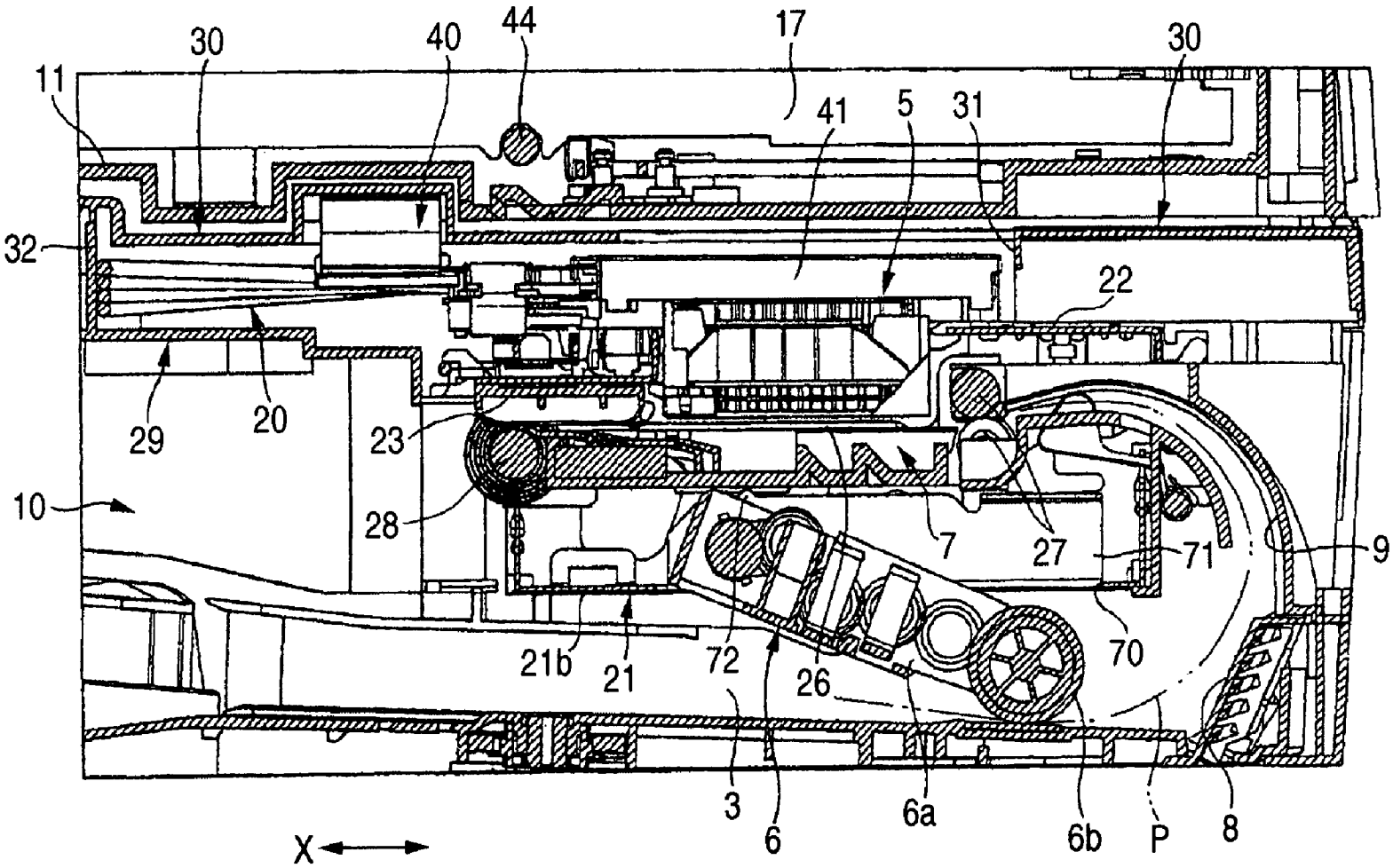
FIG. 6 is an enlarged side cross-sectional view taken along line VI-VI in FIG. 4.
Figure 10:
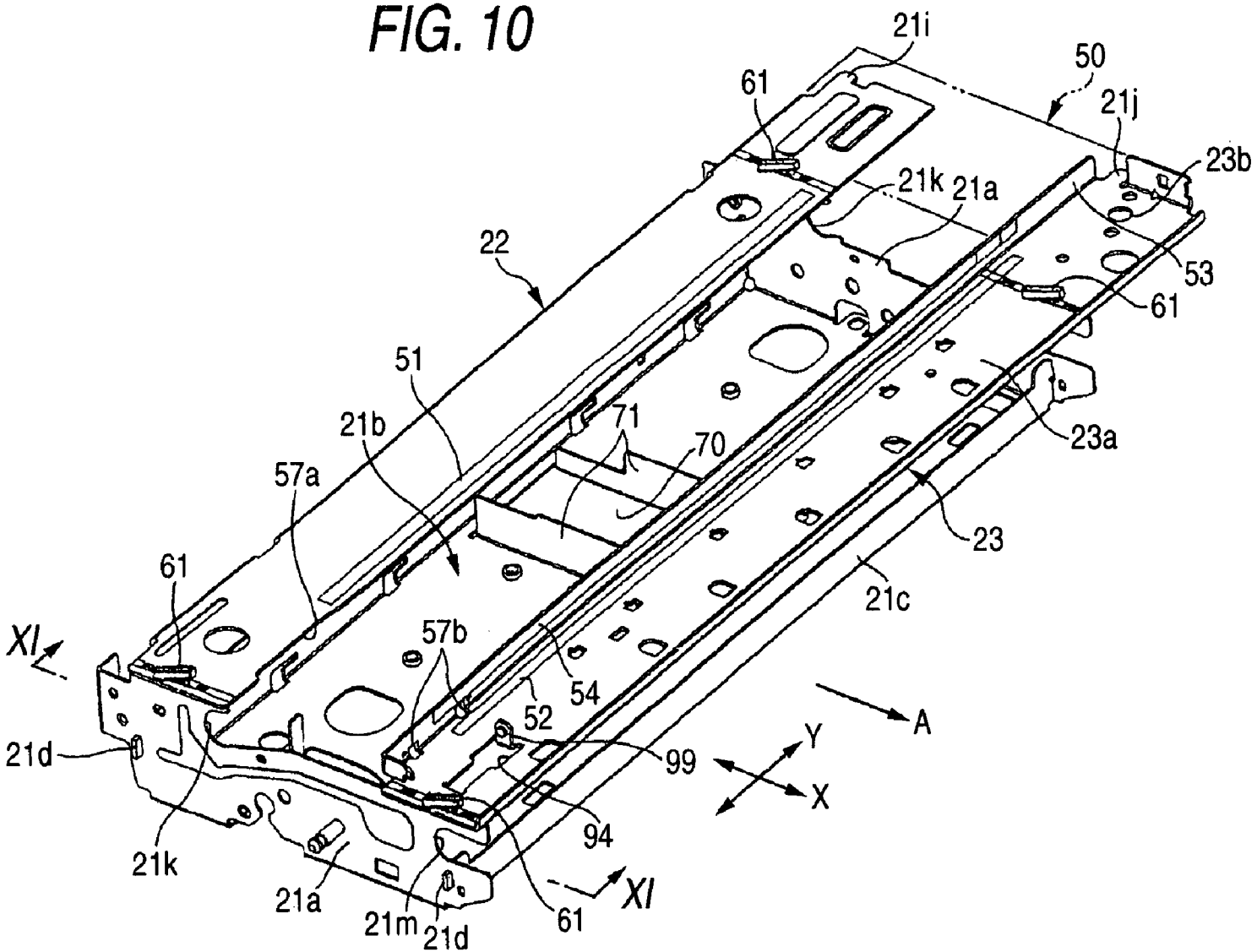
FIG. 10 is a perspective view of a state where the pair of guide plates are attached to a main frame.
Figure 11:
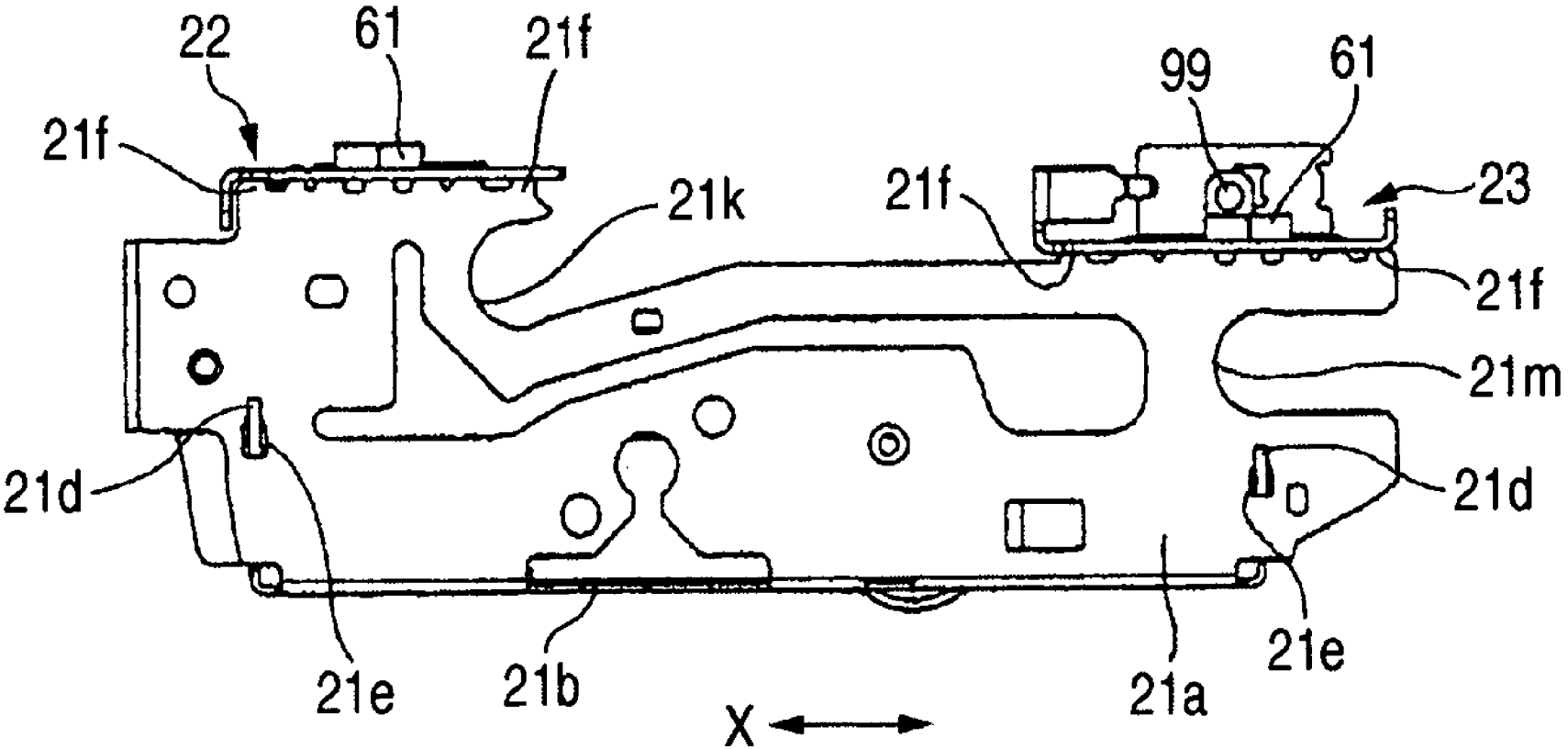
FIG. 11 is a cross-sectional view taken along line XI-XI in FIG. 10.

A guide piece 53 is formed by upwardly bending, into a substantially perpendicular position, an upstream portion of the downstream guide plate 23 with respect to the paper transport direction, and a second slide surface 54 which faces downstream in the paper transport direction is formed (see FIGS. 8, 10, and 6).

As shown in FIGS. 7 and 10, the right ends of the first and second guide plates 22, 23 extend rightward beyond the right side plate 21*a*. The maintenance unit 50 is situated so as to straddle an area between the projecting portions of the first and second guide plates 22, 23 and the right side plate 21*a*. In order to mount the maintenance unit 50, tongued tabs 21*i*, 21*j* serving as attachment portions are caused to project rightward from the right ends of the horizontal plates of the first and second guide plates 22, 23 (see FIG. 10). These tongued tabs 21*i*, 21*j* are horizontally inserted into and fittingly positioned in the latching holes (not shown) of the maintenance unit 50.

An opening 70 which can house the paper feed arm 6*a* and the paper feed roller 6*b* of the paper feed mechanism 6 is formed in the bottom plate 21*b* of the main frame 21. A pair of shaft support plates 71 are upwardly formed on both sides of the opening 70 so as to stand upright, by means of cutting and bending. Shaft holes 71*a* which enable rotatray support of base end portions of the paper feed arm 6*a* are formed in the respective shaft support plates 71 (see FIG. 9). In order to define the height position of the oblate platen 26, which extends in the direction of the Y axis so as to oppose the lower surface of the recording head 4 of the carriage 5, projections 72 are provided on the upper end of the pair of shaft support plates 71 as well as on one side plate 21*a* (the right side plate 21*a* in FIG. 9) (see FIG. 9). According to the projections, the dimension of a clearance existing between the upper surface of the platen 26 attached to the main frame 21 and the lower surface of the recording head 4 (clearance which enables passage of the paper P) can be defined accurately.

The carriage 5 has first slidable projection sections 55*a*, 55*b* and a plurality of removal prevention claws 56*a*, 56*b*. The first slidable projection sections 55*a*, 55*b* protrude from the lower surface of the carriage 5 and come into contact with the first slide surfaces 51, 52 of the guide plates 22, 23. The plurality of removal prevention claws 56*a*, 56*b* are arranged so as to catch the first and second guide plates 22, 23 in conjunction with the first slidable projection sections 55*a*, 55*b*.

In the embodiment, the first slide projection section 55*a* which comes into contact with the first slide surface 51 of the first guide plate 22 is disposed in substantially the center of the carriage 5 with respect to the horizontal direction thereof (the main scanning direction). The two first slide projections 55*b*, which come into contact with the first slide surface 52 of the second guide plate 23, are spaced apart from each other, as required, in the horizontal direction (the main scanning direction). The two removal prevention claws 56*a* and the two removal prevention claws 56*b* are provided on respective sides so as to face the lower surfaces of the first and second guide plates 22, 23. The first slide projection sections 55*b* and the removal prevention claws 56*a*, 56*b* are provided in the vicinity of the lateral ends of the carriage 5 when viewed from the top (see FIGS. 7, 12, and 13).

The three first slide projections 55*a*, 55*b*, and 55*b* are arranged in a triangular pattern (preferably an isosceles triangle) on the carriage 5 when viewed from the top, whereby the carriage 5 is stably supported by the first and second guide plates 22, 23. With a view toward causing the first slide projection sections 55*a*, 55*b* to slide smoothly while receiving the weight of the carriage 5 in place of the guide plates 22, 23, a plurality of recessed grooves 58—which retain lubrication grease and extend long in the direction of the X axis—are formed in the lower surfaces (the support surfaces or slide surfaces) of the first slide projections 55*a*, 55*b* while being spaced at appropriate intervals, in the main scanning direction (the direction of the Y axis).

Two slide projection sections 59, 60 which are to be brought into contact with the second slide surface 54 (a vertical slide surface) of the second guide plate 23 are provided in respective two locations on the carriage 5. One of the second slide projection sections (second slide projection section 59) is formed integrally with a holder case 161 of the carriage 5 and arranged such that the vertical guide piece 53 is sandwiched between a nipping piece 62 and the second slide projection section 59. A space between the nipping piece 62 and the second slide projection section 59 is opened in the main scanning direction and the downward direction (see FIGS. 12 and 13).

The other of the second slide projection sections (second slide projection section 60) and a nipping piece 63 are provided by way of posture adjustment mechanism 64 for adjusting the attachment posture of the carriage 5 with respect to the perpendicular guide piece 53 of the second guide member 23. An adjustment member block 65 is moved in the direction of the X axis in accordance with the rotational position of an adjustment knob 68 and that of a dial plate 69, thereby enabling control of the degree of projection of the second slide projection section 60 in relation to the guide pie 53. The posture of the carriage 5 can be adjusted and changed around the location where a slide surface of the first slide projection section 59 remains in contact with the guide piece 53 when viewed from the top.

A partition (lower cover member) 29 made of synthetic resin is provided so as to cover the space above the paper discharge section 10 from the lower surface of the guide plate 23 located downstream of the paper transport direction to the paper discharge port 10*a* located at the front edge of the housing 2, at a position which is essentially on the same level with the bottom plate 21*b* of the main frame 21. The partition 29 is formed integrally with the housing 2 (see FIG. 6).

An upper cover 30 is disposed so as to be appropriately spaced apart above from the partition (lower cover member) 29 and to cover the space above the carriage 5 and the reciprocal travel path thereof. A rectangular window hole 31 is formed in an intermediate portion of the upper cover member 30 so as to enable acquisition of a view of the reciprocal travel path of the carriage 5 from above (see FIG. 3). When the paper P has caused a jam in the recording section 7, the user can remove the paper P from this window hole 21 by rotating the image-reading device 12 by way of the housing 2. In this case, the ink supply tubes 20 are not pulled above the platen 26, thereby facilitating removal of the paper P.

As shown in FIGS. 7 and 8, a plurality of notched sections 57*b* (one on the right and one on the left) are formed at given positions (positions substantially above the ink receiving section 38) along an upstream edge (a corner facing the guide piece 53) of the second guide plate 23 in relation to the transport direction and leftwardly outside of a recording region for the paper P in the main scanning direction (in the direction of the Y axis). Notched sections are formed as to oppose the pair of notched sections 57*b*. In the first guide plate 22, a notched section 57*a* whose end section downstream in the transport direction is rectangular is formed; and a notched slope section 57*c* is formed at a portion rightward from the right end of the rectangular notched section 57*a*. At the positions of the notched sections 57*a* and 57*b*, the carriage 5 can be separated from the guide plates 22 and 23.

Figure 13:
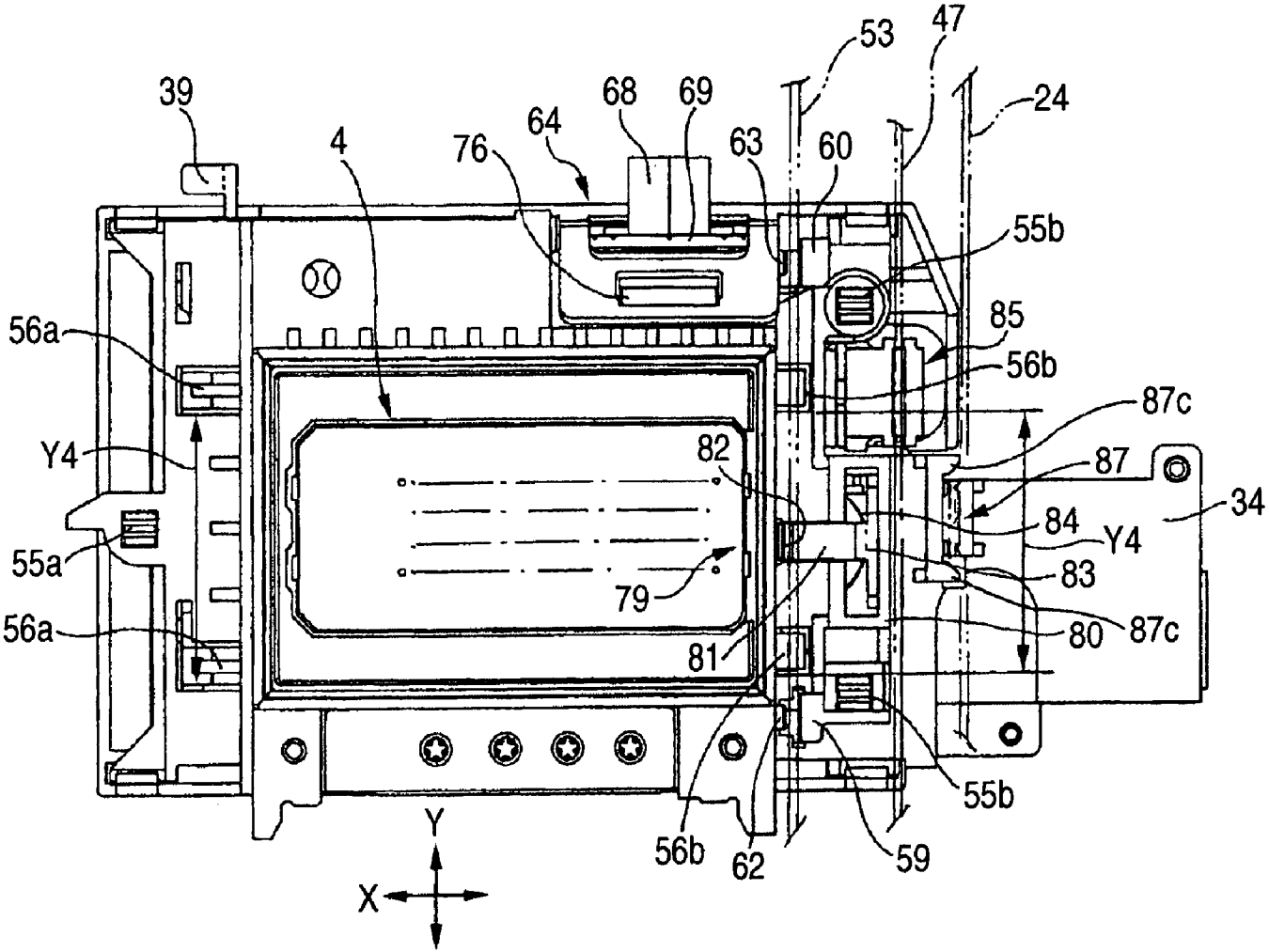
FIG. 13 is a bottom view of the carriage.
Figure 14:
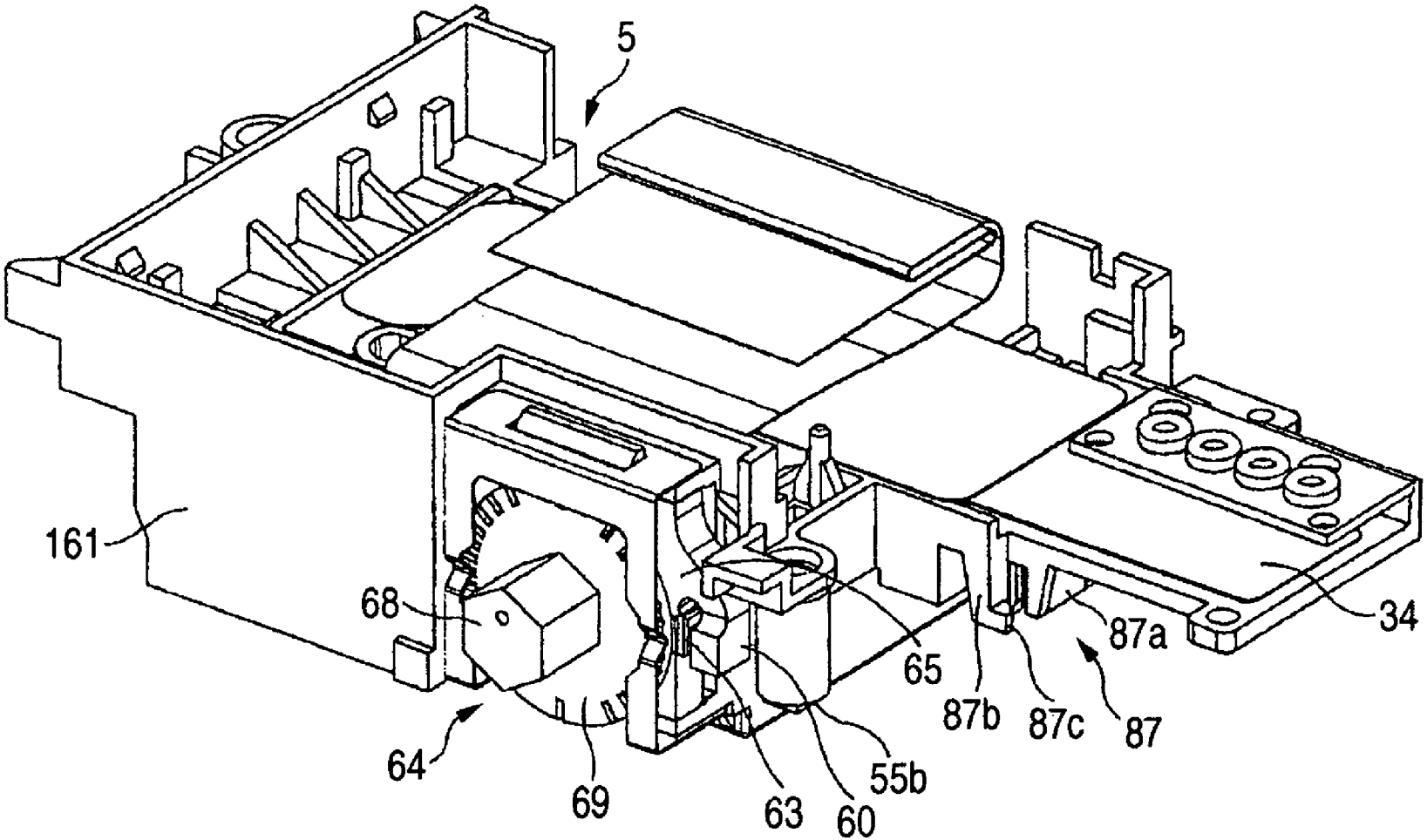
FIG. 14 is a perspective view of the carriage, showing a state where an upper cover body is removed.

Meanwhile, a distance Y4 between the two notched sections 57*b* in the second guide plate 23 is set to be identical with a pitch Y4 between the two removal prevention claws 56*b* provided on the right and left (see FIGS. 8 and 13).

Figure 12:
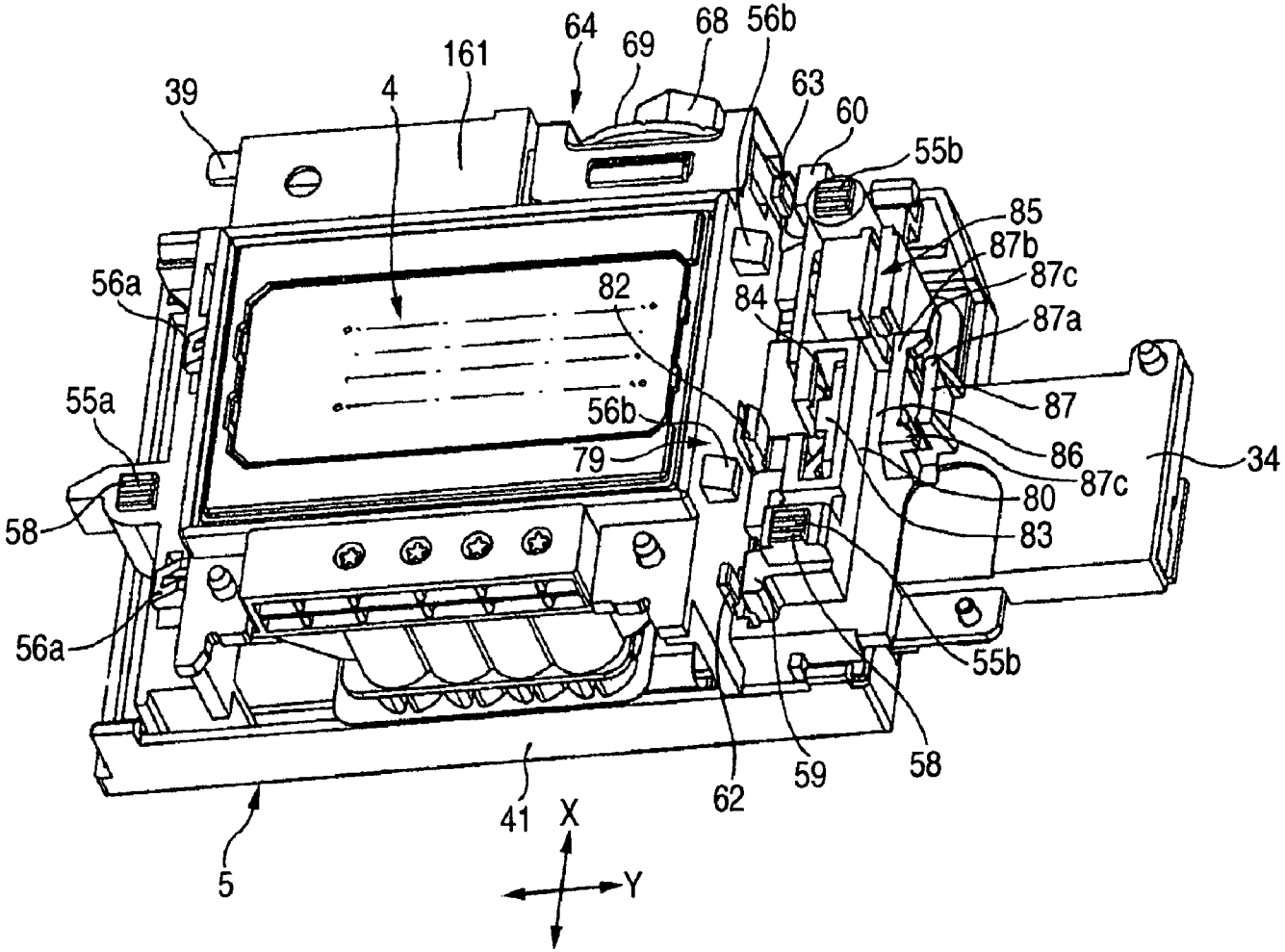
FIG. 12 is a perspective view showing a lower face side of the carriage.
Figure 18:
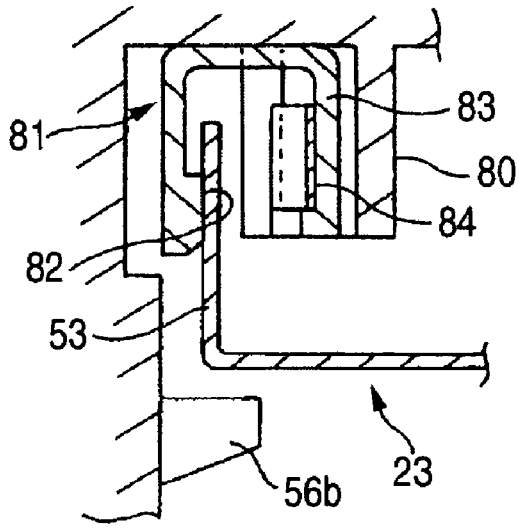
FIG. 18 is a cross-sectional view of urging member against a vertical guide piece of the second guide plate.

Meanwhile, between the pair of second slidable projection sections 59 and 60 in the direction of the Y axis, a urging member 79 is disposed. The urging member constantly presses the vertical guide piece 53 on the second guide plate 23 onto the slide surface of the pair of second slidable projection sections 59 and 60. The embodiment is configured as follows. As shown in FIGS. 12, 13, and 18, a support section 80 of substantially transverse U-shaped in plan view is integrally and downwardly formed on a lower face of the holder case 161, which is an injection molded article of a synthetic resin. A spring-receiving section 83 of a pressing body 81, which is of transverse U-shape in side profile and on one side of which a third slidable projection section 82 is formed, is disposed in such a manner that the spring-receiving section is movable in the support section 80 in the direction of the X axis. Opposite ends of a plate spring 84—which is an elastic member of arc shape in plan view—are supported on an inner face of the support section 80, and a center section of the plate spring 84 presses the spring-receiving section 83. By virtue of this configuration, the third slidable projection section. 82 resiliently forces the guide piece 53 in the direction of the slide surface of the pair of second slidable projection sections 59 and 60, thereby enabling constant sliding contact.

The carriage 5 includes a light-transmission-type sensor (photocoupler) 85 for detecting its own location. A downwardly-open guide groove 86 through which the encoder strip 47 can pass in the direction of the Y axis is formed in the vicinity of a joint section between the holder case 161 and a joint piece 34, which will be described later, in the carriage 5. At a position adjacent to the guide groove 86, the photocoupler is disposed so as to sandwich the encoder strip 47 from the front and the back thereof (see FIGS. 12, 13, and like). The photocoupler 85 is also open in the direction of the Y axis and downward.

Next, a configuration for reciprocally actuating the carriage 5 along the main scanning direction will be described in detail. As shown in FIGS. 7, 8, and like, a drive pulley 89 and a driven pulley 90 are disposed on opposite ends, in the main scan direction, of the upper surface of a horizontal plate section 23*a* on one of the guide plates (in the embodiment, the second guide plate 23). A portion of the timing belt 24 wrapped around the pulleys 89 and 90 is fixedly connected to an attachment portion 87 which is disposed in the vicinity of the joint section, in the carriage 5, between the holder case 161 and the joint piece 34. When the above configuration is employed, an expensive component, such as a guide shaft, is negated. In addition, the second guide plate 23 performs both a function of supporting sliding motion of the carriage 5, and a function of attachment of moving means, such as the drive pulley 89 and the driven pulley 90. Accordingly, there are realized effects of saving cost and miniaturizing the recording section 7, and consequently the image recording device 1.

As shown in FIGS. 12 to 15, the attachment portion 87 includes two blocks 87*a* and 87*b* which are separated by a groove section, which is open both to the lower face side of the carriage 5 and in the main scanning direction, and in which the timing belt 24 is fit. On a lower end of one block 87*b*, at a position lower than the lower end of the other block 87*a*, there are disposed a pair of latching tabs 87*c* for latching a lower end edge of the timing belt 24 for preventing the timing belt from coming off in the downward direction.

Figure 19:
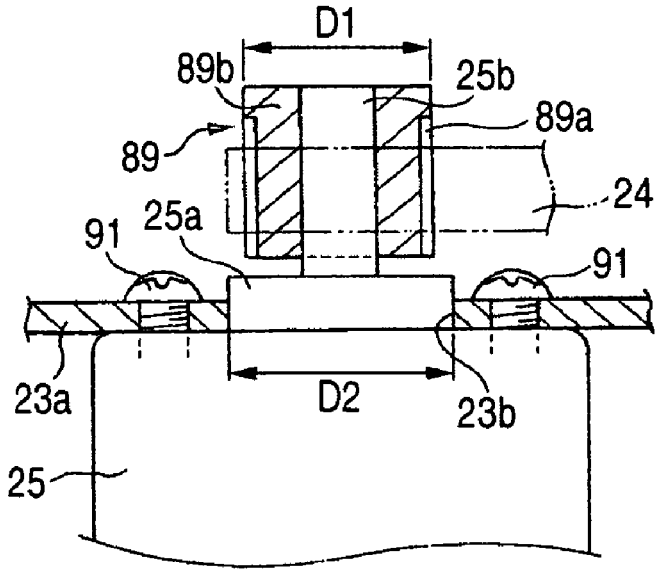
FIG. 19 is an enlarged cross-sectional view taken along line XIX-XIX in FIG. 7.
Figure 23:
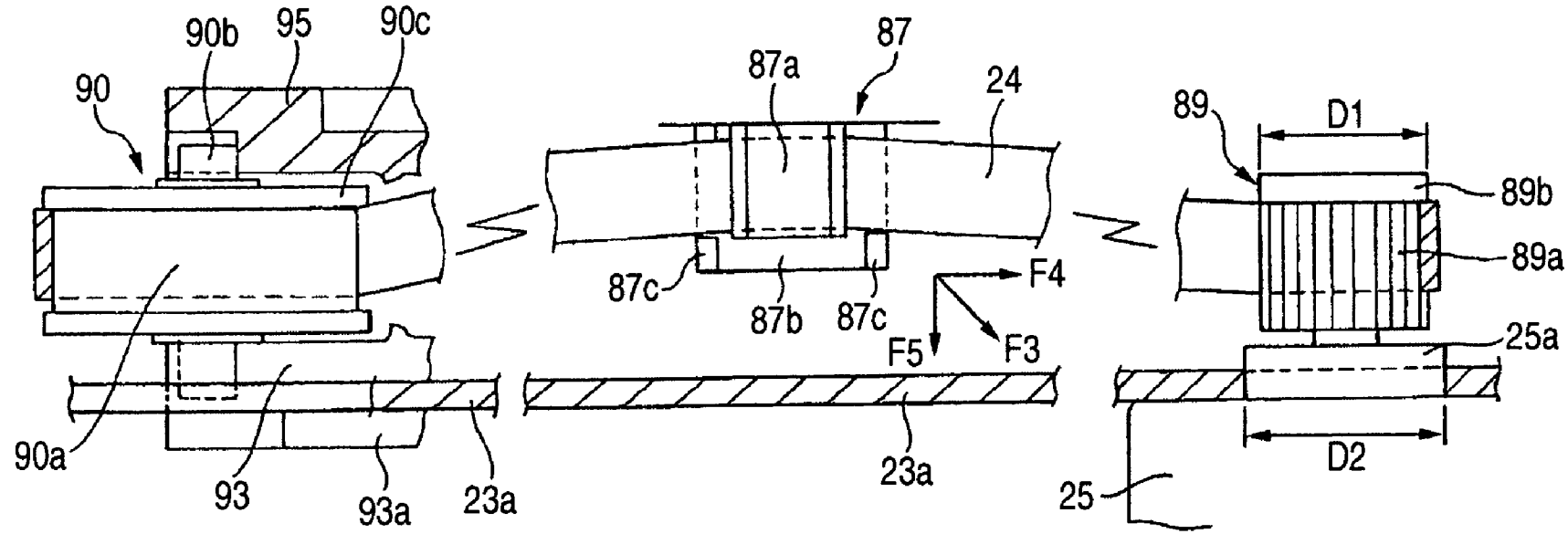
FIG. 23 is an explanatory view taken along line XXIII-XXIII in FIG. 22.

Meanwhile, the drive pulley 89, attached to a drive shaft 25*b* projecting from a head 25*a* of the carriage motor (the drive motor) 25, is formed so as to have a maximum diameter D1 smaller than a diameter D2 of the head 25*a* (see FIGS. 19 and 23). In a state that the drive pulley 89 is attached and fixed to the drive shaft 25*b*, the drive pulley 89 and the head 25*a* are inserted, from below, in an attachment hole 23*b* (having the same diameter D2 as the head 25*a*) formed in the horizontal plate section of the second guide plate 23. Subsequently, the drive motor 25 is secured from the upper face of the horizontal plate section 23*a* by means of a screw 91.

As described above, when the maximum diameter D1 of the drive pulley 89 is formed smaller than the diameter D2 of the head 25*a* of the drive motor 25, and the attachment hole 23*b* having a diameter substantially equal to the diameter D2 of the head 25*a* is formed in the second guide plate 23, the drive pulley 89 can be fitted on the drive shaft 25*b* prior to attachment of the drive motor 25 to the second guide plate 23. In addition, the only requirement for the horizontal plate section 23*a* of the second guide plate 23 is to form therein the attachment hole 23*b* for attaching the drive motor 25. Accordingly, the mechanical strength of the second guide plate is not decreased to a drastic extent. Furthermore, as compared with an attachment structure where the horizontal plate section 23*a* is disposed between the head 25*a* and the drive pulley 89, the drive pulley 89 can be arranged in much closer proximity to the head 25*a*. When a tooth surface (gear tooth profile) 89*a* for the timing belt is formed on a circumferential face of the drive pulley, slip does not occur between the rotation of the drive motor 25 and traveling of the timing belt. In addition, a flange 89*b* for preventing the timing belt 24 from coming off is integrally formed on the upper end side of the drive pulley 89. The outer periphery of the flange 89*b* is set to be identical with the maximum diameter of the drive pulley 89 (see FIG. 19).

Meanwhile, the driven pulley 90 is formed, integrally from a synthetic resin, of a pulley portion 90*a* and shaft portions 90*b*. The pulley portion 90*a* is wrapped by the timing belt 24, and the shaft portions 90*b* project, in opposite directions, from the pulley portion 90*a* along a rotational center axis thereof (see FIG. 20A). In addition, the pulley portion 90*a* includes a large-diameter flange 90*c* for preventing release of opposite ends, in the width direction, of the timing belt 24 in the direction along the shaft portions 90*b*.

A diameter D3 (corresponding to a diameter of the pulley portion 90*a*) of the driven pulley 90 is formed so as to be, at least, larger than the maximum diameter D1 of the drive pulley 89. In the embodiment, D3 is set to be substantially twice of D1. When the driven pulley 90 is integrally formed, as described above, the number of components can be reduced, and manufacturing cost can be lowered.

Figure 20A:
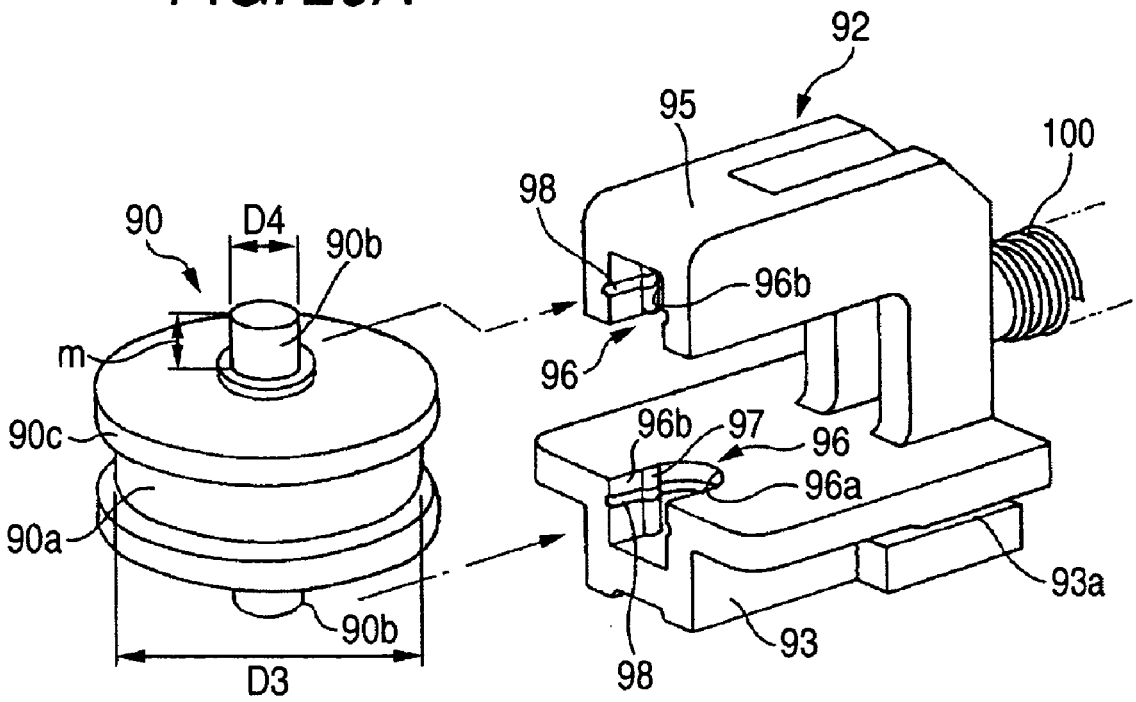
FIG. 20A is a perspective view of a driven pulley and a holder.

Here, a reason why the diameter of the driven pulley 90 is preferably set to be large will be described. As shown in FIG. 20A, when a diameter of the shaft portion 90*b* of the drive pulley 89 is assumed D4, length of the same is assumed to be "m," a diameter of the pulley portion 90*a* is assumed to be D3, and a velocity of the timing belt 24 is assumed to be Vo, a circumferential velocity of the shaft portions 90*b* of the driven pulley 90 V1 is obtained as: (D4/D3)×Vo.

Hence, in a case where a value of D4 is constant, when diameter D3 of the pulley portion 90*a* is increased, the circumferential velocity V1 of the shaft portions 90*b* is decreased. Here, a PV value will be described. The PV value is a value intrinsic to each material, and the material starts melting when a limit value PVs is exceeded. P denotes a pressure applied to the material, and V denotes a circumferential velocity of the shaft portion.

Here, when a length of each of the shaft portions 90*b* of the driven pulley 90 made of a synthetic resin for use in the embodiment is assumed to be "m," and a pressure to act on the shaft portions 90*b* is assumed to be F, a pressure is obtained as follows: P=F/(D4×m). Meanwhile, when a PV value of the shaft portions 90*b* of the driven pulley 90 is assumed to be PVs, the following is obtained:

PVs=P×V1=[F/(D4×m)]×[(D4/D3)×Vo]=(F×Vo)/(m×D3). Accordingly, the longer the length "m" of each of the shaft portions 90*b* of the driven pulley 90 and the greater the diameter D3 of the pulley portion 90*a* (the section engaging with the timing belt 24), the smaller the PV value. Consequently, a sufficient margin is allowed for the threshold value PVs of the material of the driven pulley 90. Meanwhile, when the length "m" of the shaft portions 90*b* is increased, runout of the driven pulley 90 is increased, whereby rattling easily occurs. In addition, a holder 92 to be described later is also increased in height, to thus be increased in volume. However, even when the diameter D3 of the pulley portion 90*a* is increased, the volume is not increased and compactness is achieved. Furthermore, when the diameter D3 of the pulley portion 90*a* is increased, even when a velocity Vo of the timing belt 24 or a force F acting on the shaft portions 90*b* is increased, seizing of the shaft portion 90*b* against a bearing portion 96 of the holder 90 does not occur.

Figure 20B:
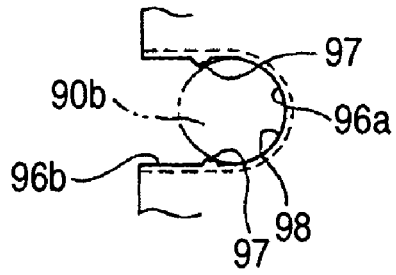
FIG. 20B is a plan view of the driven pulley and the holder.
Figure 21:
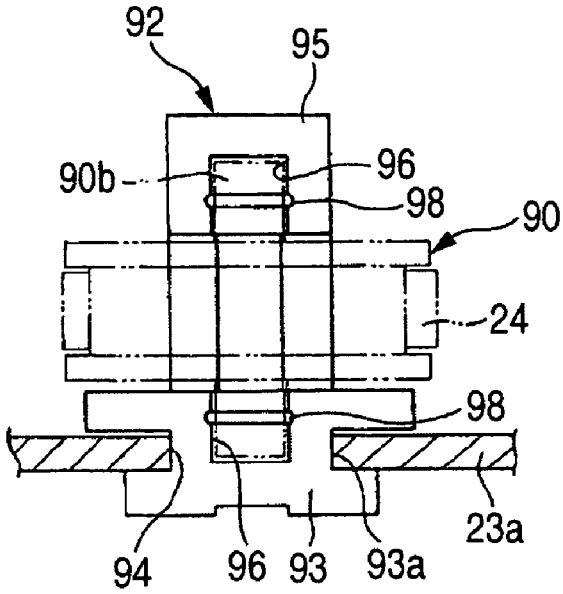
FIG. 21 is a cross-sectional view taken along line XXI-XXI in FIG. 7.

The driven pulley 90 is detachably and pivotably supported in the holder 92, which is an injection molded article of synthetic resin, from a lateral direction of the holder 92. The configuration of the holder 92 will be described hereinbelow. As shown in FIGS. 20A, 20B, and 21, the holder 92 includes a base plate 93 of a substantially T-shaped profile and an upper support section 95 having an inverted L-shaped side view protruding from the base plate 93. The base plate 93 is fit in an attachment hole 94 formed in the horizontal plate section 23*a* of the second guide plate 23 and to be located on the upper face side of the horizontal plate section 23*a*. A pair of left and right engagement grooves 93*a* for sandwiching the horizontal plate section 23*a* are formed in the lower face side of the base plate 93.

As shown in FIG. 10, the attachment hole 94 is elongated in the direction of the main scanning direction. In addition, on the side where the drive pulley 89 is to be located, the attachment hole 94 is of about a size through which the lower section of the base plate 93 can be fit-inserted; and on the side where the attachment hole 94 is remote from the drive pulley 89, the hole is a rectangular-shaped hole having such a width that the pair of engaging grooves 93*a* can pass therethrough and that the base plate 93 is prevented from coming off in the vertical direction. According to this configuration, the holder 92 is attached movably in the main scanning direction along the horizontal plate section 23*a*. In addition, a bearing portion 96 for rotatably supporting a lower shaft portion 90*b* of the driven pulley 90 is disposed on one side (the side by way of which the driven pulley departs from the drive pulley 89) of the base plate 93, and another bearing portion 96 for supporting an upper shaft portion 90*b* is disposed on the same of the upper support section 95.

For the purpose of enabling substantially horizontal attachment and removal of the whole driven pulley 90 to and from the holder 92 from a side by way of which the pulley departs from the drive pulley 89, the following configuration is adopted. That is, each of the upper and lower bearing portion sections 96, 96 is formed into a substantially transverse U-shape in plan view. Hence, the lower bearing portion 96 includes an opening on one side (one side end face by way of which the driven pulley departs from the drive pulley 89) of the base plate 93, and the upper bearing portion 96 includes an opening on the same side of the upper support section 95. Of each of the upper and lower bearing portions 96, 96, a semi-circular section 96*a* (which is semi-circular in plan view), which comes into contact with the circumferential face of the shaft portion 90*b*, is formed on the side which is closer to the drive pulley 89. In addition, ribs 97 for preventing unintended coming-off of the shaft portion 90*b* to the open-end face side are integrally formed on line sections 96*b* that continue from the semi-circular section 96*a* (see FIG. 20B). Meanwhile, there may be a case that the openings of the upper and lower bearing portion sections 96 are opened in, e.g., a sub-scanning direction, so long as the driven pulley does not approach the drive pulley 89 in the direction of the openings (i.e., an opened direction). Furthermore, in an inner circumferential surface of each of the upper and lower bearing portion sections 96, a concave groove 98 for retaining lubricant grease is formed so as to horizontally communicate with the semi-circular section 96*a* and the line sections 96*b* (see FIGS. 20A and 20B).

When grease is retained in the concave groove 98, even when the shaft portion 90*a* of the driven pulley 90 is made of a synthetic resin and is of low abrasion resistance, the shaft portion 90*a* has a small frictional resistance in relation to the bearing portion 98, whereby the driven pulley 90 can rotate smoothly (with light friction).

For the purpose of elastically forcing the holder 92 in the direction away from the drive pulley 89, a compression coil spring 100 (see FIGS. 7 and 20A), serving as elastically urging member, is laid between a spring support piece 99 (see FIG. 10) formed upright at the position of the attachment hole 94 and a flat face of the upper support section 95 of the holder 92.

As shown in FIGS. 7 and 8, the drive pulley 89 and the driven pulley 90 are arranged while being offset from each other such that, of the timing belt 24 wrapped around (spanned across) the drive pulley 89 and the driven pulley 90, a direction in which a side piece fixedly connected to the carriage 5 extends becomes substantially parallel to the vertical guide piece 53 on the second guide plate 23; and the minimum distance between a shaft center (a rotational center) of the drive pulley 89 and the guide piece 53 becomes smaller (shorter) than a distance between a shaft center (a rotational center) of the driven pulley 90 and the guide piece 53. Under this situation, when the carriage 5 is moved in the main scanning direction, the carriage 5 tows the timing belt 24 so as to be parallel with the guide piece 53. Accordingly, the carriage 5 is moved stably along the second slide face 54 (a reference face) at the guide piece 53, thereby enhancing performance in recording images. In this case, when the driven pulley 90 having a large diameter is located remote from the guide 53, the second guide plate 23 can be reduced in width in the direction of arrow A, thereby enabling miniaturization.

That is, as shown in FIGS. 7 and 8, the rotational center of the drive pulley 89 and the rotational center of the driven pulley 90 are disposed to be deviated from each other to arrange the timing belt 24 to extend in a direction substantially parallel to the main scanning direction at a side where the carriage 5 is attached.

In other words, the rotational center of the drive pulley 89 and the rotational center of the driven pulley 90 are disposed to be deviated from each other such that a line connecting the upstream-side ends of the pulley portions of the drive pulley and the driven pulley is substantially parallel to the main scanning direction.

Furthermore, the positional relationship among the drive pulley 89, the driven pulley 90, and the attachment portion 87 of the carriage 5 to which the timing belt 24 is connected is preferably set so that a force component (a component force) of the tension—exerted by the timing belt 24 of the side to which the carriage 5 is attached—acts so as to press the carriage 5 in a direction toward either one or both of the horizontal plate section 23*a* of the second guide plate 23 and the guide piece 53, which is a vertical piece, of the same. This is because, when this arrangement is employed, motion of the carriage 5 is stabilized.

Figure 22:
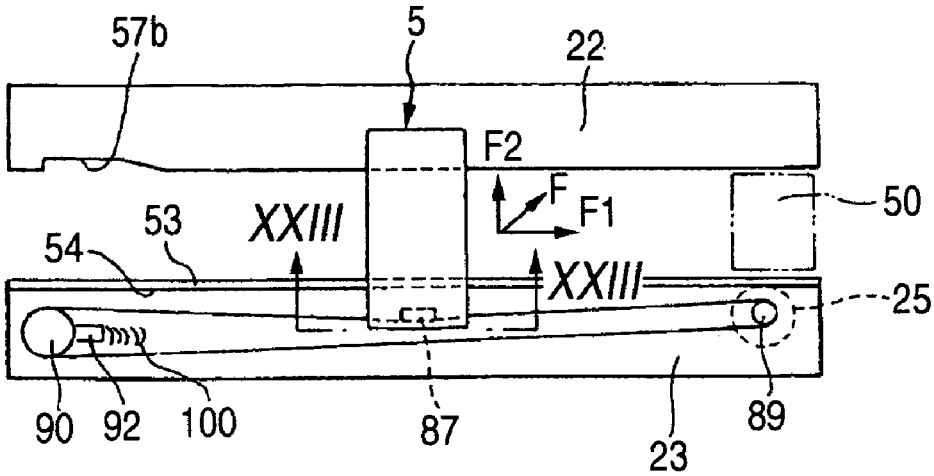
FIG. 22 is a plan view explaining states of a tension and component forces of a timing belt.

FIG. 22 shows an embodiment where the carriage 5 is pressed against the guide piece 53, which is a vertical piece of the second guide plate 23. In the embodiment, the minimum distance between the attachment portion 87 of the carriage 5 connected to the timing belt 24 and the second slide face 54 of the guide piece 53 is set to become greater than the shortest distances between the minimum distance between portions of the timing belts 24 wound around the drive pulley 89 and the driven pulley 90 and the second slide surface 54. By virtue of this configuration, as shown in FIG. 22, of component forces F1, F2 of a tension F exerted on the timing belt 24 at the attachment portion 87, the component force F2—which acts in a direction orthogonal to a direction along which the guide piece 53 extends—presses the carriage 5 against the second slide surface 54 at the guide piece 53 on the side where the timing belt 24 is placed. Accordingly, a posture of the carriage 5 during the course of movement is stabilized, thereby enhancing performance in recording images.

FIG. 23 shows an embodiment where the carriage 5 is pressed against the first slide face 52 on the upper face of the horizontal plate section 23*a* of the second guide plate 23. In the embodiment, the height of the attachment portion 87 of the carriage 5 to which the timing belt 24 is connected is upwardly offset from a position where the timing belt 24 is wrapped around the drive pulley 89 and the driven pulley 90. In this case, the pair of latching tabs 87*c* protruding on both lower ends of the block 87*b*, which is one of the blocks on the attachment portion 87, latches a lower end edge of the timing belt 24 having been fitted between the blocks 87*a* and 87*b* so as to prevent coming-off in the upward direction; the flange 89*b* on the upper end of the drive pulley 89 restricts the upper end edge of the timing belt so as to prevent coming-off in the upward direction; and, furthermore, the flange 90*c* on the upper side of the driven pulley 90 restricts the upper end edge of the timing belt 24 so as to prevent coming-off in the upward direction.

In the embodiment, of component forces F4, F5 of a tension F3 exerted on the timing belt 24 at the attachment portion 87, the component force F5—which acts in a direction orthogonal to a direction along which the horizontal plate section 23*a* extends—presses the carriage 5 against the first slide surface 52, which is a reference face of the upper face of the horizontal plate section 23*a*. Accordingly, a gap clearance between the lower face of the recording head 4 on which the carriage 5 is mounted and the paper P on the platen 26 is stabilized, thereby enhancing performance in recording images.

Figure 24A:
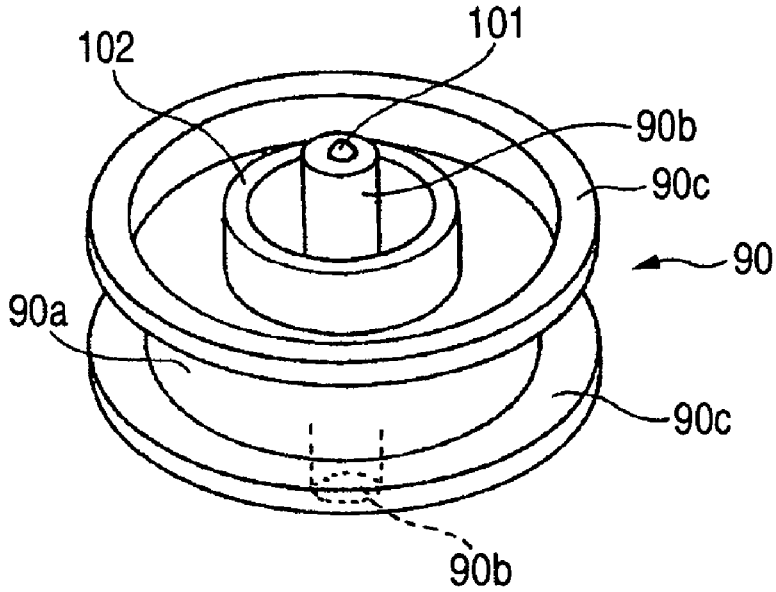
FIG. 24A is a perspective view showing another embodiment of the driven pulley.
Figure 24B:
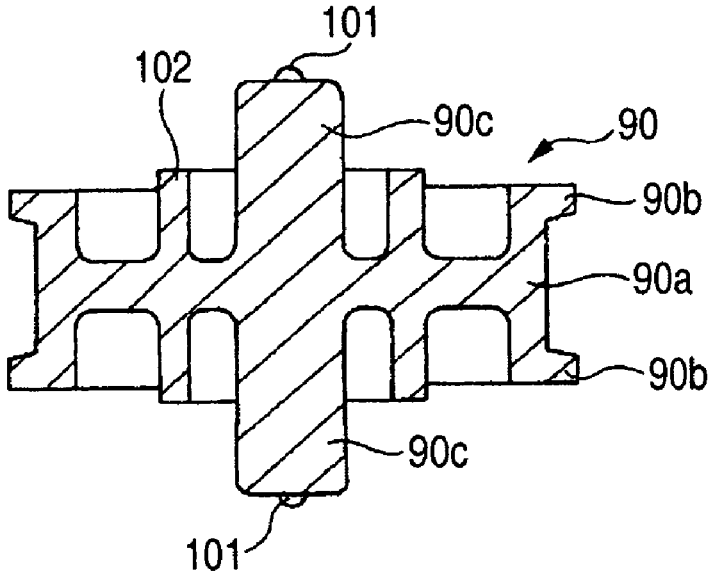
FIG. 24B is a cross-sectional view showing the same.

As shown in FIGS. 24A and 24B, slidable protrusions 101 are formed on end faces (an upper end face and a lower end face) of the pair of shaft portions 90*b* of the driven pulley 90 for attachment in the holder 92. The slidable protrusion 101 includes a convex-curved surface, such as hemispheric surface, which comes into contact with the end face (a flat face orthogonal to the rotation axis) of the bearing portion 96 in the holder 92. When the above configuration is employed, rather than the entire end face of the lower bearing portion 90*b* of the driven pulley 90 coming into contact with the end face of the bearing portion 96, an extremely small contact face (or a contact point) of the slidable protrusion 101 comes into contact with the end face of the bearing portion 96. As a result, rotational resistance (rolling frictional force) of the driven pulley 90 is reduced to an extremely small value, thereby enabling smooth rotation.

As also shown in FIGS. 24A and 24B, for the purpose of restricting the motion of the driven pulley 90 in the direction along the shaft, an annular contact portion 102 is disposed on the outer face (the end face) of the pulley portion 90*a* (or the flange 90*c*) of the driven pulley 90, on the outer periphery side of the shaft portion 90*b*. The contact portion 102 has a small contact area, and comes into contact with the upper face of the base plate 93 of the holder 92 and with the lower face of the upper support section 95 of the same. When the above configuration is employed, even when an external force to pull the following pulley 90 in the lateral direction acts by the tension exerted by the timing belt 24, since the contact portion 102 comes into contact with the upper face of the base plate 93 and with the lower face of the upper support section 95, a rotation posture where the axis of the shaft portion 90*b* orthogonally intersects the upper face of the base plate 93 can be maintained. When the contact portion 102 is formed into an annular shape in plan view for the purpose of reducing the contact area, the rotational resistance (rolling frictional force) of the driven pulley 90 is reduced to an extremely small value, thereby enabling smooth rotation.

A capping cover member 41 for covering the upper surface of the holder case 161 is removably attached to the upper surface of the carriage 5. A control board (not shown), which outputs a predetermined drive signal to the recording head upon receipt of a signal from a flexible flat cable 40 to be described later, is provided on the lower surface of the capping cover member 41. Removal and attachment of the capping cover member 41 is required for performing maintenance such as replacement of the control board. A block tab 39 is formed integrally with the capping cover member 41 and extends downward so as to face the lower surface of the upstream guide plate 22 (see FIGS. 12 and 13). The block tab 39 is provided so as to be substantially flush with removal prevention claws 56*a*, and is situated in a position offset from one of the removal prevention claws 56*a* in the main scanning direction by an appropriate dimension.

In the embodiment, the flexible ink supply tubes 20*a* to 20*d* that couple, at all times, the respective ink cartridges housed in the ink storage section 15 to the recording head 4 of the recording section 7 are mutually-independent tube members and used while being made equal in length to each other.

Figure 4:
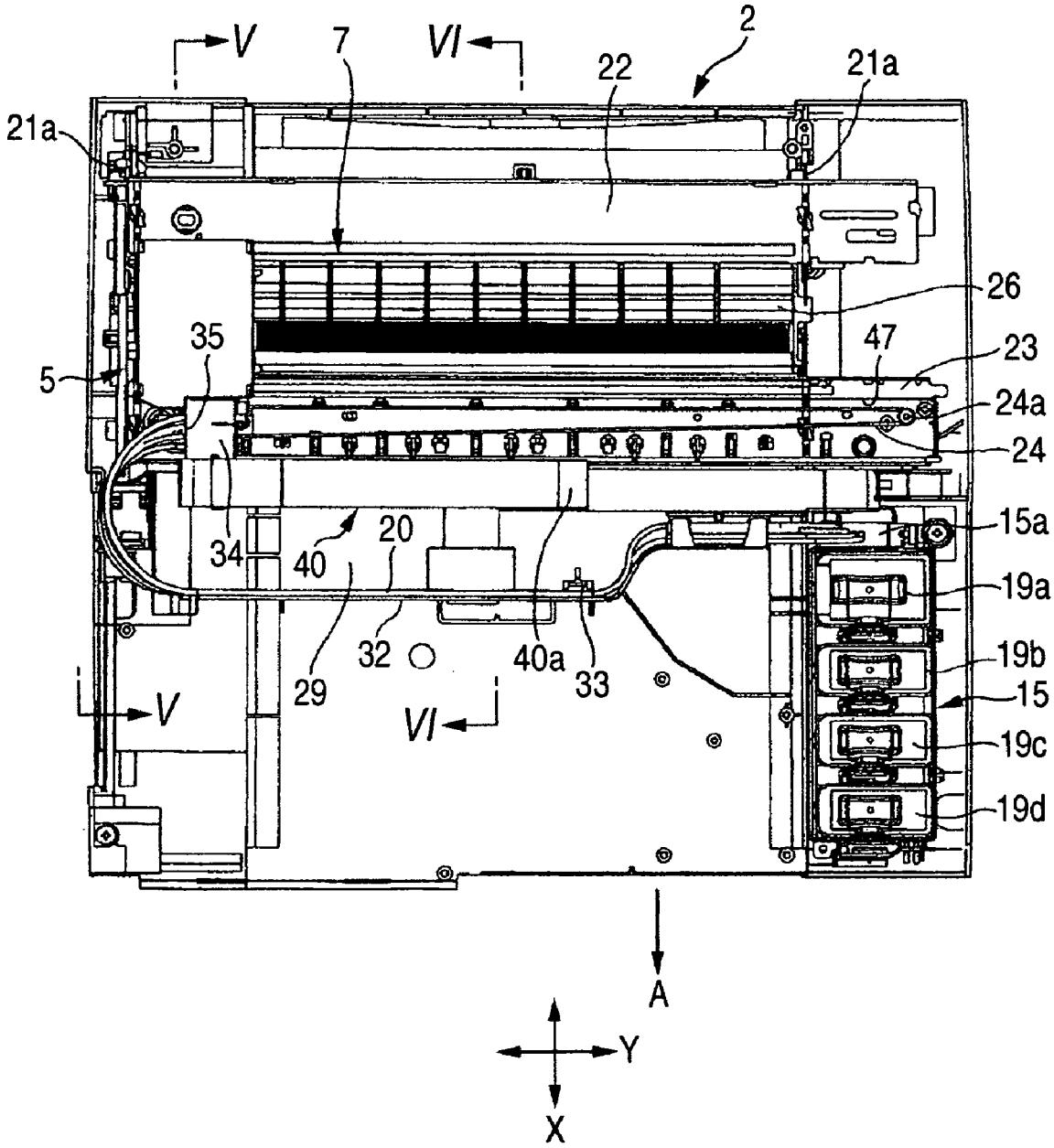
FIG. 4 is a plan view of the housing, showing a state where an upper cover body is removed.

As shown in FIG. 4, base portions of the plurality of the ink supply tubes 20 (four tubes in the embodiment) are bundled at one end 15*a* of the ink storage section 15 and extend over the upper surface of a lower cover member 29 from one end (the right end in FIG. 4) to the other end (the left end in FIG. 4) in the direction of the Y axis. At this time, the base portions of all the ink supply tubes 20*a* to 20*d* are arranged in a lateral line over the upper surface of the substantially-horizontal lower cover member 29. At least portions (intermediate portions or the like) of the ink supply tubes 20 are supported by the upper surface of the lower cover member 29.

Next, all the ink supply tubes 20*a* to 20*d* are twisted such that the intermediate portions of the supply tubes run over one vertical surface (substantially perpendicular surface) of a horizontally-elongated vertical partition 32 of the lower cover member 29. The intermediate portions of all the ink supply tubes 20*a* to 20*d* are arranged in a vertical line and fixed (shrouded or sandwiched) between the one vertical surface of the vertical partition 32 and a fixing member 33 which is fastened with screws so as to oppose the one vertical surface of the vertical partition 32, is made of synthetic resin, and assumes the shape of a vertical plate. The area where all of the ink supply tubes 20*a* to 20*d* are fixed (shrouded) between the fixing member 33 and the one vertical surface of the vertical partition 32 becomes an intermediate fixed section. The intermediate fixed section may be configured in, e.g., a configuration such that intermediate portions of all the ink supply tubes 20*a* to 20*d* are arranged in a single vertical line and fixed (shrouded or caught) in a downwardly-U-shaped or upwardly-U-shaped fixing member (not shown).

The carriage 5 is provided with a joint piece 34 extending in substantially a horizontal direction downstream of the paper transport direction (the direction of arrow A). While being arranged in a substantially horizontal line, tip ends of all the ink supply tubes 20*a* to 20*d* are connected to a coupling section (a connection section) 35 provided on the left end of the joint piece 34 shown in FIG. 4. Within the area from the intermediate fixed section (the fixing member 33) to the coupling section (the connection section) 35, the orientation of the intermediate sections of all the ink supply tubes 20*a* to 20*d* is changed from left to right, and the ink supply tubes are twisted such that phases of lines (arrangements) of all the ink supply tubes 20*a* to 20*d* are changed from the substantially vertical direction at the intermediate fixed section (the fixing member 33) to a substantially horizontal direction at the coupling section (the connection section) 35. That is, the intermediate portions of the four ink supply tubes 20*a* to 20*d* are curved within the area between the travel path of the carriage 5 and the intermediate fixed section (the fixing member 33) such that the orientation of the intermediate portions is changed through 180° when viewed from the top. The ink supply tubes are laid such that the orientation of the four ink supply tubes 20*a* to 20*d*, which are arranged in the curved intermediate position and extend toward the intermediate fixed section, is made different in phase from the orientation of the four ink supply tubes 20*a* to 20*d*, which are arranged in the carriage 5 and extend toward the coupling section 35 of the ink supply tubes 20*a* to 20*d*.

As mentioned above, the intermediate portions of all the ink supply tubes 20*a* to 20*d* [an area from the intermediate fixed section (the fixing member 33) to the coupling section (connection section) 35; that is, an unbundled/unrestrained area] are curved (reversed) such that the direction of the ink supply tubes extending toward the intermediate fixed section (the fixing member 33) and the direction of the ink supply tubes extending toward the coupling section 35 in the carriage 5 are made different from each other by 180°. The ink supply tubes are twisted such that the orientation of the four ink supply tubes 20*a* to 20*d*, which are arranged in the curved intermediate position and extend toward the intermediate fixed section (the fixing member 33), is made different in phase from the orientation of the four ink supply tubes 20*a* to 20*d*, which are arranged in the carriage 5 and extend toward the coupling section 35 of the ink supply tubes 20*a* to 20*d*. As a result, although the respective ink supply tubes 20*a* to 20*d* become independent of each other and curved, all the ink supply tubes 20*a* to 20*d* become easy to being bundled together. Particularly, when the ink supply tubes 20*a* to 20*d* in the intermediate fixed section (the fixing member 33) are arranged in the vertical direction (the perpendicular direction) and the ink supply tubes in the coupling section 35 are arranged horizontally, the ink supply tubes 20*a* to 20*d* in motion are less prone to separating from each other (less prone to becoming disordered) in the vertical direction in an intermediate point on the curved section. Accordingly, the posture of the ink supply tubes 20*a* to 20*d* in motion becomes stray.

Consequently, the height of a space of an area (a movable area, or a unbundled/unrestrained area) over which the ink supply tubes 20*a* to 20*d* pass when the carriage 5 travels reciprocally in the direction of the Y axis (the main scanning direction) can be made small, and the height of the housing 2 can be made compact. Moreover, if the ink supply tubes 20*a* to 20*d* are horizontally arranged in the coupling section 35, the chance of occurrence of interference with other components disposed densely around the carriage 5 is made small, and hence the height of the carriage 5 can be reduced. Moreover, even when all of the ink supply tubes 20*a* to 20*d* are independent of each other, the posture of the ink supply tubes 20*a* to 20*d* becomes stray during movement. Therefore, the necessity for an additional tube bundling device is obviated, thereby enhancing ease of assembly and contributing to cost cutting.

In the embodiment, a command signal for causing the nozzles of the recording head 4 mounted on the carriage 5 to selectively eject ink droplets is transmitted from an unillustrated control section provided in the housing 2 by way of the flexible flat cable 40. The flexible flat cable 40 is laid in an area (a movable area, or an unbundled/unrestrained area) where the ink supply tubes 20*a* to 20*d* run when the carriage 5 travels reciprocally in the direction of the Y axis (the main scanning direction), substantially in parallel to the direction in which the ink supply tubes 20 extend (see FIGS. 4 and 5).

The direction of a bulging curve in an arbitrary point of the curved portion of the ink supply tube 20 is set so as to become opposite the direction of a bulging curve in an arbitrary point on the curved portion of the flexible flat cable 40 with respect to the direction of reciprocal movement of the carriage 5. Put another way, the direction in which the ink supply tube 20 extends with respect to the coupling section 35 of the carriage 5 is set to become opposite the direction in which the flexible flat cable 40 extends with respect to the carriage 5. The flexible flat cable 40 is formed curvedly so as to become inverted upside down in an arbitrary point 40*a* on the flat cable within the space between the upper and lower cover members 30, 29.

According to this configuration, the ink supply tube 20 and the flexible flat cable 40 can be arranged substantially flush with each other (so as to fall within substantially a single plane) in the perpendicular direction, allowing the image recording device 1 to be made slim.

Figure 15:
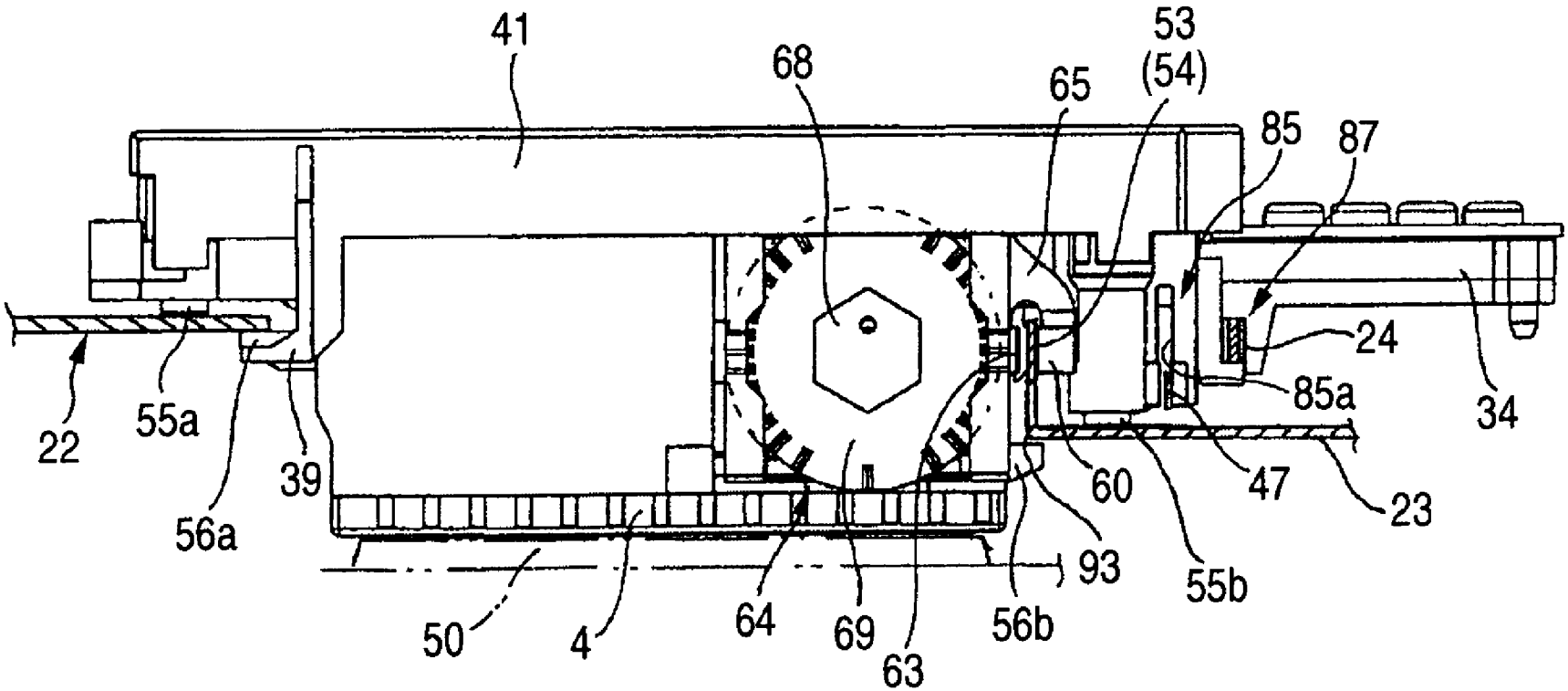
FIG. 15 is a side view of the carriage mounted on the first and second guide plates.

According to the above-described configuration, as shown in FIG. 15, the slide surface of the first slide projection section 55*a* of the carriage 5 comes into slidable contact with the first slide surface 51 of the upstream first guide plate 22, and the other two first slide projection sections 55*b* come into slidable contact with the first slide surface 52 of the downstream second guide plate 23. The vertical guide piece 53 of the second guide plate 23 is sandwiched between nipping pieces 62, 63 corresponding to the second slide projection sections 59, 60 arranged side by side. An upstream surface of the guide piece 53 is pressed by the third slide projection section 82, whereby the second slide projection sections 59, 60 come into slidable contact with the second slide surface 54 facing downstream of the guide piece 53.

In this state, the removal prevention claws 56*a* and the block tabs 39 are situated at positions close to the lower surface of the first guide plate 22, and the respective removal prevention claws 56*b* are situated at positions close to the lower surface of the downstream second guide plate 23, so that the carriage 5 cannot be removed in the upward direction from both guide plates 22, 23. The encoder strip 47, which is parallel to the guide piece 53, is located within an inspection groove 85*a* of the photocoupler 85.

The three first slide projections 55*a*, 55*b*, and 55*b* are arranged in a triangular pattern on the carriage 5, thereby defining a plane, in which the carriage 5 becomes stray with respect to the first slide surfaces 51, 52, which are horizontal surfaces of both guide plates 22, 23. The thus-defined plane can be taken as a reference vertical position of the nozzle surface of the recording head 4 on the carriage 5. The vertically-oriented guide piece 53 is nipped by the second slide projections 59, 60 located side by side and the third slide projection section 82 located therebetween. As a result, the second slide surface 54 becomes the reference for reciprocal movement of the carriage 5 or the recording head 4 in the main scanning direction.

The rows of nozzles of the recording head 4 are arranged so as to become perpendicular to the vertical guide piece 53 of the second guide plate 23 by means of the posture adjustment mechanism 64, so that the reference position can be set. The guide piece 53 is arranged at a position close to the area where the portion of the ink supply tube 20 close to the tip end thereof is curved, the supply tube being connected to the coupling section 35 of the joint piece 34 of the carriage 5. Hence, action for pressing the second slide projections 59, 60 of the carriage 5 against the second slide surface 54 of the guide piece 53 is induced by means of reaction force of the curved portion of the ink supply tube 20, so that the posture stability of the carriage 5 during movement can be enhanced to a much greater extent.

In order to remove the carriage 5 from the first and second guide plates 22, 23 for replacing the recording head in conjunction with the carriage 5, the capping cover member 41 must be removed from the carriage 5 and the guide plates 22, 23. To this end, the carriage 5 is moved to the neighborhoods of the left ends of the guide plates 22, 23 shown in FIGS. 7 and 8. The block tabs 39 are aligned to a pair of notched sections 57*a* in the second guide plate 23. Since the notched sections 57*a* of the first guide plate 22 are laterally elongated, the four removal prevention claws 56*a*, 56*b* of the carriage 5 can be readily removed from the guide plates 22, 23.

Figure 16A:
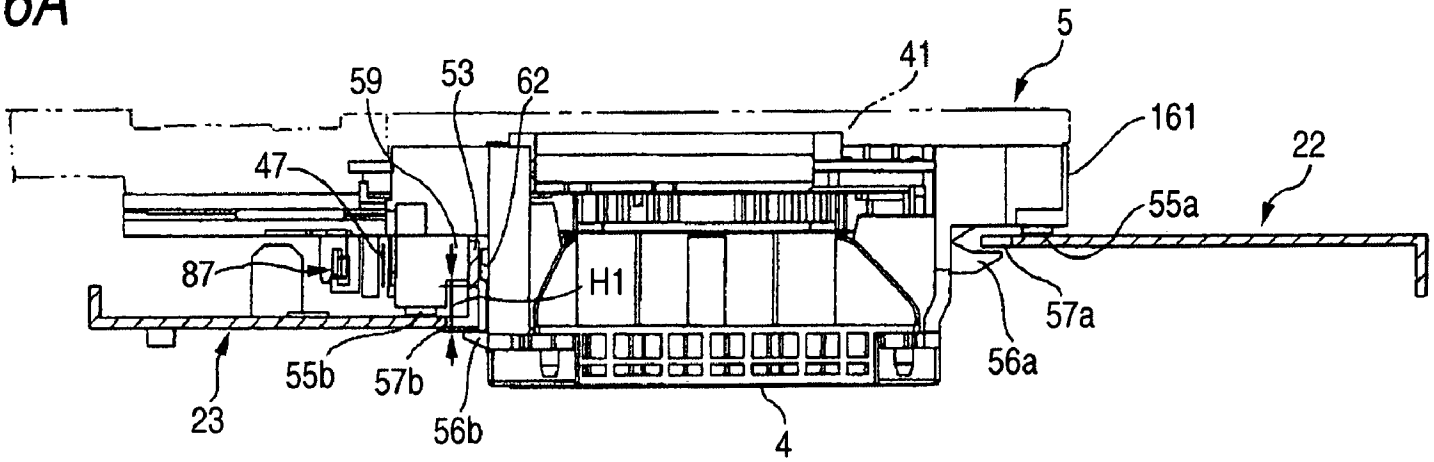
FIG. 16A is a side view of the carriage located at a removal position, showing a state where the upper cover body is removed.
Figure 16B:
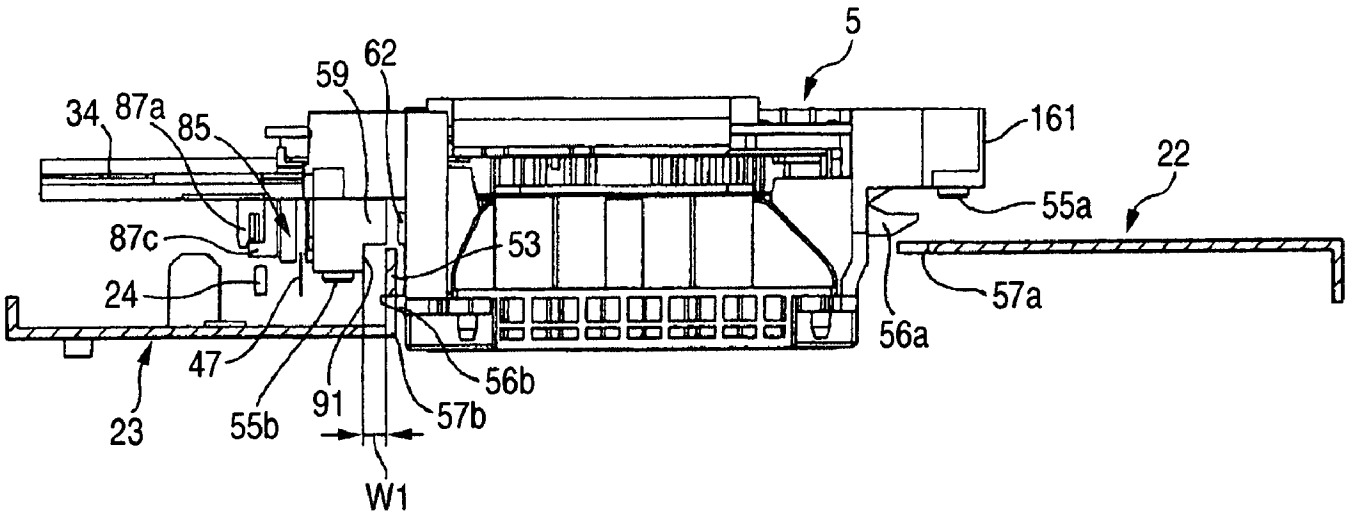
FIG. 16B is an explanatory view showing a state where the carriage is lifted only by a given distance.
Figure 17A:
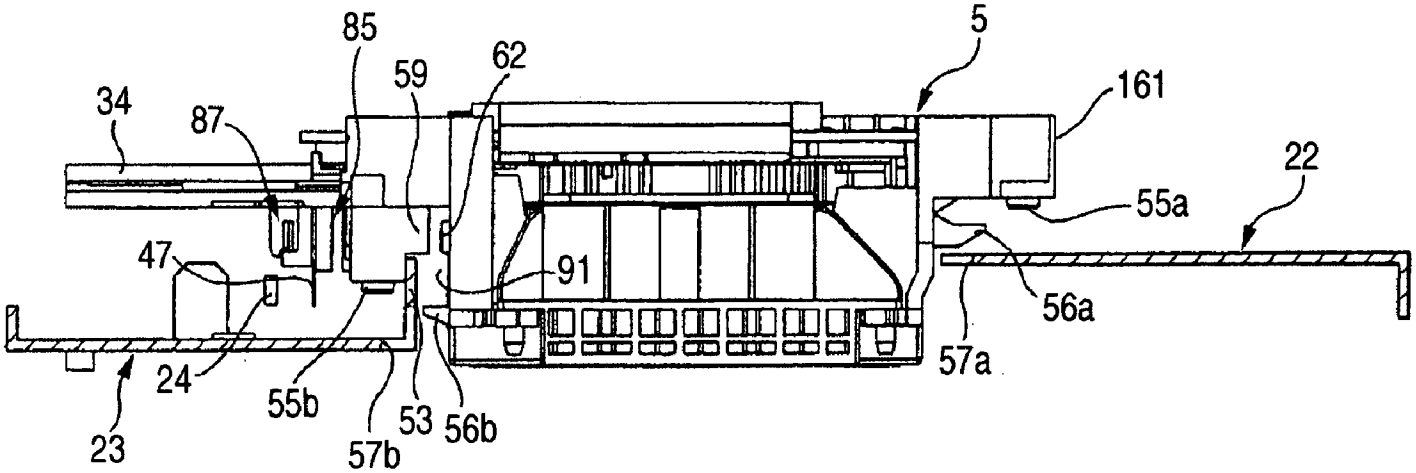
FIG. 17A is an explanatory view, showing a state where the carriage is horizontally moved by a predetermined distance.
Figure 17B:
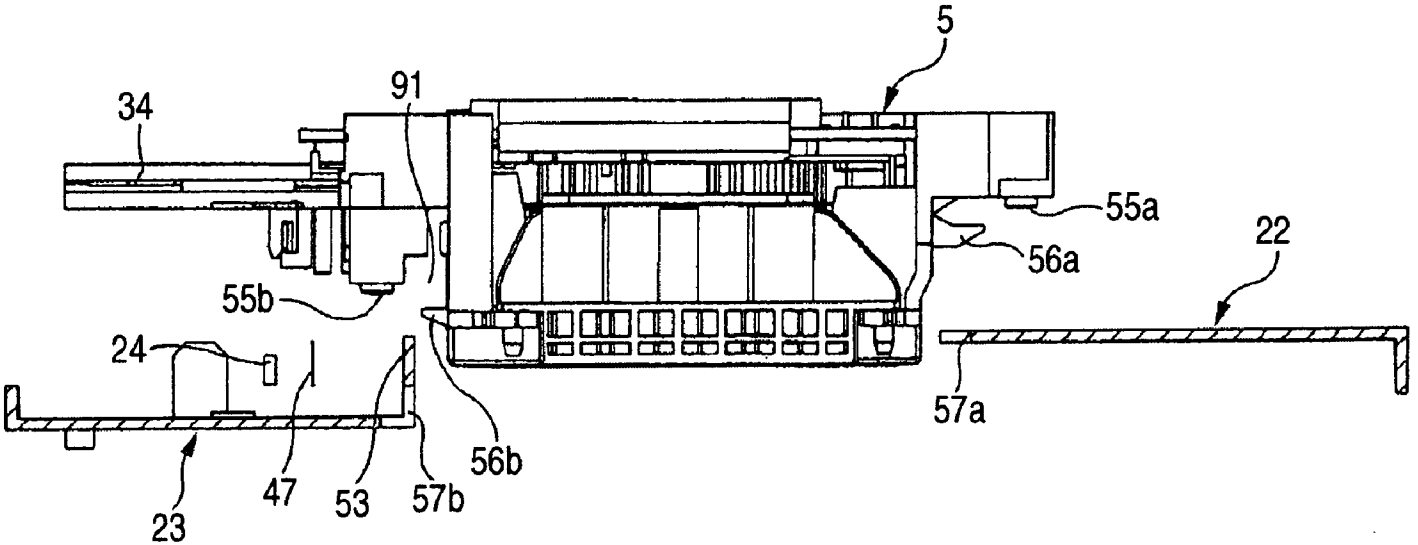
FIG. 17B is an explanatory view, showing a state where the carriage is completely separated from both guide plates.

As shown in FIG. 14B, the carriage 5 is lifted up, while being held in a substantially-horizontal state, from the state shown in FIG. 16A to the upper edge (the height H1) of the guide piece 53 of the notched sections 57*b* of the second guide plate 23. Through this lifting action, the removal prevention claws 56*a* are upwardly removed from (passed by) the notched sections 57*a* of the first guide plate 22 and are further elevated to a position where the removal prevention claws 56*b* essentially come into contact with the portions of the upper edges of the notched sections 57*a* close to the guide piece 53. Incidentally, the upper edge of the vertical guide piece 53 is also removed up to the lower edges of the second slide projection sections 59, 60 and the lower edges of the nipping pieces 62, 63. Simultaneously, the guide piece 53 goes out of the third slide projection section 82, as well. Similarly, the essential upper edge of the encoder trip 47 also downwardly goes out of the area where the photocoupler 85 is provided. As shown in FIG. 17A, the entire carriage 5 is moved essentially horizontally toward the second guide plate 23 (a downstream position in the transport direction). The distance of movement is slightly greater than the dimension W1 of the notched sections 57*b* to the depth edge of the second guide plate 23. There is formed a clearance 91 such that the upper edge of the guide piece 53 does not interfere with the lower surfaces of the second slide projection sections 59, 60, the lower surface of the third slide projection section 82, and the side surface of the first slide projection section 55*b* during horizontal movement. By means of horizontal movement, the removal prevention claws 56*b* fully go out of (pass by) the notched sections 57*b* of the vertical guide piece 53. Accordingly, the entire carriage 5 is again elevated (see FIG. 17B), so that the carriage 5 can be easily removed (detached) from the second guide plate 23 having an L-shaped cross-sectional profile, without involvement of efforts for removing the removal prevention claws 56*b* from the carriage 5. The carriage 5 can be readily removed from the guide plates 22, 23 without removing the vertical encoder strip 47 from the second guide plate 23. In addition, the timing belt 24 can be detached from the attachment portion 87 during the course of the removal operation or after the same.

In the above described image recording device 1, the timing belt, the drive pulley, the driven pulley, and the holder thereof may also be disposed on the flat plate section of the upstream first guide plate 22. Further, the diameter of the drive pulley may be made larger than the diameter of the driven pulley. Moreover, the guide plates (guide members) 22, 23 may be formed from another material other than metal (a steel plate), so long as the rigidity that is the same as that achieved in the case of the pulleys made of metal (a steel plate) is achieved.

As described above in detail, according to the embodiment, there is provided an image recording device including: a carriage that moves reciprocally in a main scanning direction that is perpendicular to a sub scanning direction in which a recording medium is transported; a recording head mounted on the carriage and discharges ink to form an image on the recording medium; first and second guide plates formed in flat-shape on which the carriage is slidably provided and extend in the main scanning direction to be parallel with each other; a drive motor mounted at one end of the second guide plate; a drive pulley fixed on a drive shaft of the drive motor; a driven pulley disposed on the second guide plate at other end opposite to the one end where the drive motor is mounted; and a timing belt that is wound around a pulley portion of the drive pulley and a pulley portion of the driven pulley, the timing belt being fixedly attached to an attachment portion of the carriage.

According to the configuration above, the necessity for expensive parts, such as a guide shaft, can be obviated and the guide plate can perform the function of slidably supporting the carriage as well as performing the function of attaching the moving mechanism such as the drive pulley and the driven pulley. Consequently, an attempt can be realized to curtail cost and, by extension, render the recording section and the image recording device compact.

According to the embodiment, when the carriage moves in the main scanning direction, the carriage can be pulled so as to become parallel to the vertical piece of one guide plate by means of the timing belt. The carriage can be stably moved along the reference surface of the vertical piece, thereby enhancing performance in recording the image. In this case, a pulley having a large diameter is spaced away from the vertical piece, thereby rendering the width of the guide plate small and compact.

According to the embodiment, the diameter of the drive pulley is rendered smaller than the diameter of the head portion of the drive motor, and a mount hole (an opening) whose diameter is essentially identical with the diameter of the head portion is formed in one guide plate in advance, so that the drive pulley can be fittingly attached to the drive shaft before attachment of the drive motor to the guide plate. Further, the essential requirement is to form, in advance, only a mount hole used for mounting a drive motor in the horizontal plate section of the guide plate by means of drilling. Hence, when compared with a mount structure where the horizontal plate section is disposed between the head portion and the drive pulley, the drive pulley can be disposed extremely close to the head portion.

According to the embodiment, an advantage of stray movement of the carriage will be yielded if a layout of the attachment portion of the carriage with respect to the drive pulley, the driven pulley, and the timing belt is set such that a component force of tension stemming from the timing belt to which the carriage is attached acts in a direction in which the carriage is pressed against either or both of the horizontal plate section of the guide plate and the vertical piece.

According to the embodiment, among the component force of the tension stemming from the timing belt in the attachment portion of the carriage, component force acting in a direction orthogonal to the longitudinal direction of the horizontal plate section exhibits an effect of pressing the carriage in motion against the slide surface that serves as the reference plane of an upper surface of the horizontal plate section. Hence, lift-up of the carriage from the guide plate can be prevented without fail. As a result, there are yielded an advantage of the dimension of clearance between the lower surface of the recording head mounted on the carriage and the recording medium becoming stray and an advantage of the ability to maintain the quality of a recorded image consistent.

According to the embodiment, among the component force of the tension stemming from the timing belt in the attachment portion of the carriage, component force acting in a direction orthogonal to the longitudinal direction of the horizontal plate section exhibits an effect of pressing the carriage against the second slide surface of the vertical piece located on the same side as that on which the timing belt is arranged. As a result, the posture of the carriage in motion becomes stray, and the recording performance of the image is enhanced.

According to the embodiment, the driven pulley can be formed integrally with the shaft portion. Hence, the number of parts can be reduced, and manufacturing costs can be curtailed.

According to the embodiment, the diameter of the driven pulley is increased, whereby the rotational speed of the driven pulley can be reduced. Even when the driven pulley is formed from synthetic resin, friction developing between the driven pulley and the bearing portion becomes small, and there is yielded an advantage of an improvement in durability of the driven pulley.

According to the embodiment, the driven pulley can be forced in a direction departing from the drive pulley by way of the holder and the elastic urging member, and appropriate tension can be imparted to the timing belt.

According to the embodiment, the driven pulley can be attached to and removed from the bearing portion of the holder in a direction substantially orthogonal to the axis of rotation of the driven pulley, thereby greatly facilitating disassembly of the carriage moving mechanism.

According to the embodiment, the area over which the driven pulley comes into contact with the bearing portion of the shaft portion can be minimized, thereby lessening rotational friction and rendering the drive motor compact.

According to the embodiment, there is yielded an advantage of the ability to stably rotate the driven pulley without inclination with respect to the holder.

According to the embodiment, lubrication grease is retained in the recessed groove, so that rotational friction resistance of the driven pulley can be minimized.

According to the embodiment, the drive motor is mounted on the second guide plate at a side (surface) opposite to a side (surface) where the drive pulley is disposed. According to this configuration, the carriage can be moved to the end of the second guide plate to a position above where the drive motor is mounted.

According to the embodiment, the first and second guide plates are provided with slide surfaces, respectively, and the carriage is slidably provided on the slide surfaces. According to this configuration, the structure and mechanism to slidably support the carriage can be simplified with respect to the conventional configuration where a round-shaft-shaped guide shaft is used for slidably supporting the carriage.

The foregoing description of the embodiment has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. An image recording device comprising:

a carriage that moves reciprocally in a main scanning direction that is perpendicular to a sub scanning direction in which a recording medium is transported;

a recording head mounted on the carriage and discharges ink to form an image on the recording medium;

first and second guide plates formed in flat-shape on which the carriage is slidably provided and extend in the main scanning direction to be parallel with each other;

a drive motor mounted at one end of the second guide plate;

a drive pulley fixed on a drive shaft of the drive motor;

a driven pulley disposed on the second guide plate at other end opposite to the one end where the drive motor is mounted; and a timing belt that is wound around a pulley portion of the drive pulley and a pulley portion of the driven pulley, the timing belt being fixedly attached to an attachment portion of the carriage.

2. The image recording device according to claim 1, wherein either one of a diameter of the pulley portion of the drive pulley and a diameter of the pulley portion of the driven pulley is formed to be larger than the other, wherein a rotational center of the drive pulley and a rotational center of the driven pulley are disposed to be deviated from each other to arrange the timing belt to extend in a direction substantially parallel to the main scanning direction at a side where the carriage is attached.

3. The image recording device according to claim 1, wherein the second guide plate is provided with an opening into which a head portion being protruded from the drive shaft of the drive motor is fittingly inserted, and wherein a diameter of the drive pulley is formed to be smaller than a diameter of the head portion.

4. The image recording device according to claim 1, wherein a layout of the attachment portion, the drive pulley, the driven pulley, and timing belt is configured such that a component force of tension stemming from the timing belt acts in a direction to press the carriage against the second guide plate.

5. The image recording device according to claim 4, wherein the second guide plate is provided with a horizontal slide surface on an upper surface thereof, the horizontal slide surface being parallel to a head surface of the recording head and supporting the carriage, and wherein a vertical position at which the timing belt is placed on the attachment portion is higher than vertical positions at which the timing belt is wrapped around the drive pulley and the driven pulley.

6. The image recording device according to claim 4, wherein the second guide plate is provided with a horizontal first slide surface parallel to a head surface of the recording head and an upwardly oriented vertical piece having a second slide surface extending in the main scanning direction orthogonal to the first slide surface, and wherein a distance shortest between the attachment portion and the second slide surface is configured to be greater than either of:

a distance shortest between the pulley portion of the drive pulley and the second slide surface; and a distance shortest between the pulley portion of the driven pulley and the second slide surface.

7. The image recording device according to claim 1, wherein the pulley portion and a shaft portion of the driven pulley are integrally formed with synthetic resin material.

8. The image recording device according to claim 7, wherein a diameter of the pulley portion of the driven pulley is configured to be larger than a diameter of the pulley portion of the drive pulley.

9. The image recording device according to claim 7, further comprising:

a holder that axially supports the shaft portion of the drive pulley and is removably attached to the second guide plate; and an elastic urging member that urges the holder in a direction in which an interval between the drive pulley and the driven pulley becomes greater.

10. The image recording device according to claim 9, wherein the holder is provided with:

a pair of bearing portions that axially supports the shaft portion that projects from the pulley portion of the driven pulley in opposite directions along an axis of rotation; and a pair of opened portions respectively formed in side surfaces of each of the bearing portions to open in a direction opposite to a side confronting the driven pulley, the opened portions enabling removable attachment of the shaft portion in a direction orthogonal to the axis of rotation.

11. The image recording device according to claim 9, wherein the driven pulley is provided with a slidable contact projection formed on an end face of the shaft portion, the slidable contact projection abutting with end face of the bearing portion.

12. The image recording device according to claim 9, wherein the driven pulley is provided with a contact portion on the pulley portion, the contact portion contacting with the holder for regulating axial movement of the driven pulley.

13. The image recording device according to claim 10, wherein the holder is provided with recessed grooves formed in each of inner peripheral surfaces of the bearing portions, the recessed grooves retaining lubrication grease therein.

14. The image recording device according to claim 1, wherein the drive motor is mounted on the second guide plate at a side opposite to a side where the drive pulley is disposed.

15. The image recording device according to claim 1, wherein a rotational axis of the drive pulley and a rotational axis of the driven pulley are provided to be orthogonal to both of the main scanning direction and the sub scanning direction.

16. The image recording device according to claim 1, wherein the first and second guide plates are provided with slide surfaces, respectively, and wherein the carriage is slidably provided on the slide surfaces.

17. The image recording device according to claim 1, wherein either one of a diameter of the pulley portion of the drive pulley and a diameter of the pulley portion of the driven pulley is formed to be larger than the other, wherein each of the pulley portion of the drive pulley and the pulley portion of the driven pulley has first and second ends in the sub scanning direction, the first end being closer to the carriage than the second end, and wherein a rotational center of the drive pulley and a rotational center of the driven pulley are disposed to be deviated from each other such that a line connecting the both first ends of the pulley portions of the drive pulley and the driven pulley is substantially parallel to the main scanning direction.

18. The image recording device according to claim 1, wherein the drive shaft of the drive motor extends in a direction substantially perpendicular to a head surface of the recording head.

19. The image recording device according to claim 1, wherein the second guide plate is provided with a surface which is parallel to a head surface of the recording head and a width of the second guide plate in the sub scanning direction is larger than a diameter of the drive pulley.

* * * * *